US010047495B2

(12) United States Patent
Imaizumi et al.

(10) Patent No.: US 10,047,495 B2
(45) Date of Patent: Aug. 14, 2018

(54) LOADER CONTROL SYSTEM AND LOADER CONTROL METHOD

(71) Applicant: Komatsu Ltd., Tokyo (JP)

(72) Inventors: Masaaki Imaizumi, Tokyo (JP); Ken Hirabayashi, Tokyo (JP); Satoshi Kousuge, Tokyo (JP)

(73) Assignee: Komatsu Ltd., Tokyo (JP)

( * ) Notice: Subject to any disclaimer, the term of this patent is extended or adjusted under 35 U.S.C. 154(b) by 63 days.

(21) Appl. No.: 15/509,249

(22) PCT Filed: Oct. 28, 2016

(86) PCT No.: PCT/JP2016/082099
§ 371 (c)(1),
(2) Date: Mar. 7, 2017

(87) PCT Pub. No.: WO2017/126182
PCT Pub. Date: Jul. 27, 2017

(65) Prior Publication Data

US 2018/0119384 A1 May 3, 2018

(51) Int. Cl.
*E02F 3/43* (2006.01)
*E02F 3/34* (2006.01)
(Continued)

(52) U.S. Cl.
CPC ..... *E02F 3/439* (2013.01); *E02F 3/3417* (2013.01); *E02F 3/432* (2013.01); *E02F 9/2029* (2013.01); *E02F 3/845* (2013.01); *E02F 9/0875* (2013.01)

(58) Field of Classification Search
CPC ..... E02F 3/439; E02F 3/3417; E02F 3/432; E02F 3/433; E02F 3/434; E02F 3/0875; E02F 9/2029; E02F 9/0875; E02F 9/264
(Continued)

(56) References Cited

U.S. PATENT DOCUMENTS 6,609,315 B1 * 8/2003 Hendron ..... E02F 3/28 37/348
7,752,778 B2 * 7/2010 Schoenmaker ..... E02F 9/264 37/348
(Continued)

FOREIGN PATENT DOCUMENTS

CN 104619922 A 5/2015
CN 105339560 A 2/2016
(Continued)

OTHER PUBLICATIONS

International Search Report and Written Opinion dated Jan. 31, 2017, issued for PCT/JP2016/082099.
(Continued)

*Primary Examiner* — Richard A Goldman
(74) *Attorney, Agent, or Firm* — Locke Lord LLP

(57) ABSTRACT

A loader control system includes: a boom position calculation unit configured to calculate a position of a boom rotatably supported by a vehicle body of a loader; a bucket attitude calculation unit configured to calculate an attitude of a bucket rotatably supported by the boom; a determination unit configured to determine whether the attitude satisfies a predetermined condition on the basis of the attitude and a reference attitude of the bucket in dumping movement; and a work machine control unit configured to cause the bucket to carry out the dumping movement, and output a control signal to cause the boom to carry out lifting movement when the attitude is determined to satisfy the predetermined condition.

9 Claims, 16 Drawing Sheets

[FIRST UNLOADING]

(51) Int. Cl.
*E02F 9/20* (2006.01)
*E02F 9/08* (2006.01)
*E02F 3/84* (2006.01)

(58) Field of Classification Search
USPC ..... 701/50; 37/348, 382, 416
See application file for complete search history.

(56) References Cited

U.S. PATENT DOCUMENTS 8,200,398 B2 * 6/2012 Sahlin ..... E02F 3/847 37/416
8,500,387 B2 * 8/2013 Trifunovic ..... E02F 3/434 37/348
8,958,958 B2 * 2/2015 Imura ..... E02F 9/123 701/50
9,238,899 B2 * 1/2016 Matsumoto ..... E02F 3/3417
9,481,976 B2 11/2016 Kami et al.
9,834,905 B2 * 12/2017 Matsuyama ..... E02F 3/435
2007/0260380 A1 * 11/2007 Mintah ..... E02F 9/2029 701/50
2008/0097672 A1 * 4/2008 Clark ..... E02F 3/434 701/50
2009/0003984 A1 * 1/2009 Osanai ..... B66F 9/065 414/697
2009/0222176 A1 * 9/2009 Florean ..... E02F 3/432 701/50
2010/0254793 A1 * 10/2010 Trifunovic ..... E02F 3/432 414/700
2016/0002881 A1 * 1/2016 Park ..... E02F 3/432 701/50
2016/0145827 A1 * 5/2016 Kami ..... E02F 3/437 701/50
2016/0251824 A1 * 9/2016 Arimatsu ..... E02F 3/435 701/50
2016/0281323 A1 * 9/2016 Imaizumi ..... E02F 9/0841
2017/0089033 A1 * 3/2017 Matsuyama ..... E02F 3/435

FOREIGN PATENT DOCUMENTS

CN 105518222 A 4/2016
JP 04-070348 U 6/1992
JP 07-034483 A 2/1995
JP 08-189056 A 7/1996
JP 2001-032330 A 2/2001
JP 2007-224511 A 9/2007
JP 2009-052287 A 3/2009
WO 2015/129932 A1 9/2015

OTHER PUBLICATIONS

Supplementary European Search Report dated Jan. 9, 2018, issued for the European patent application No. 16840286.5.

* cited by examiner

[FIRST UNLOADING]
[SECOND UNLOADING]
[THIRD UNLOADING]
[FOURTH UNLOADING]
1J
Zsa
31
32
SR
501
500
<CONTACT>

[FIRST UNLOADING]

[FOURTH UNLOADING]

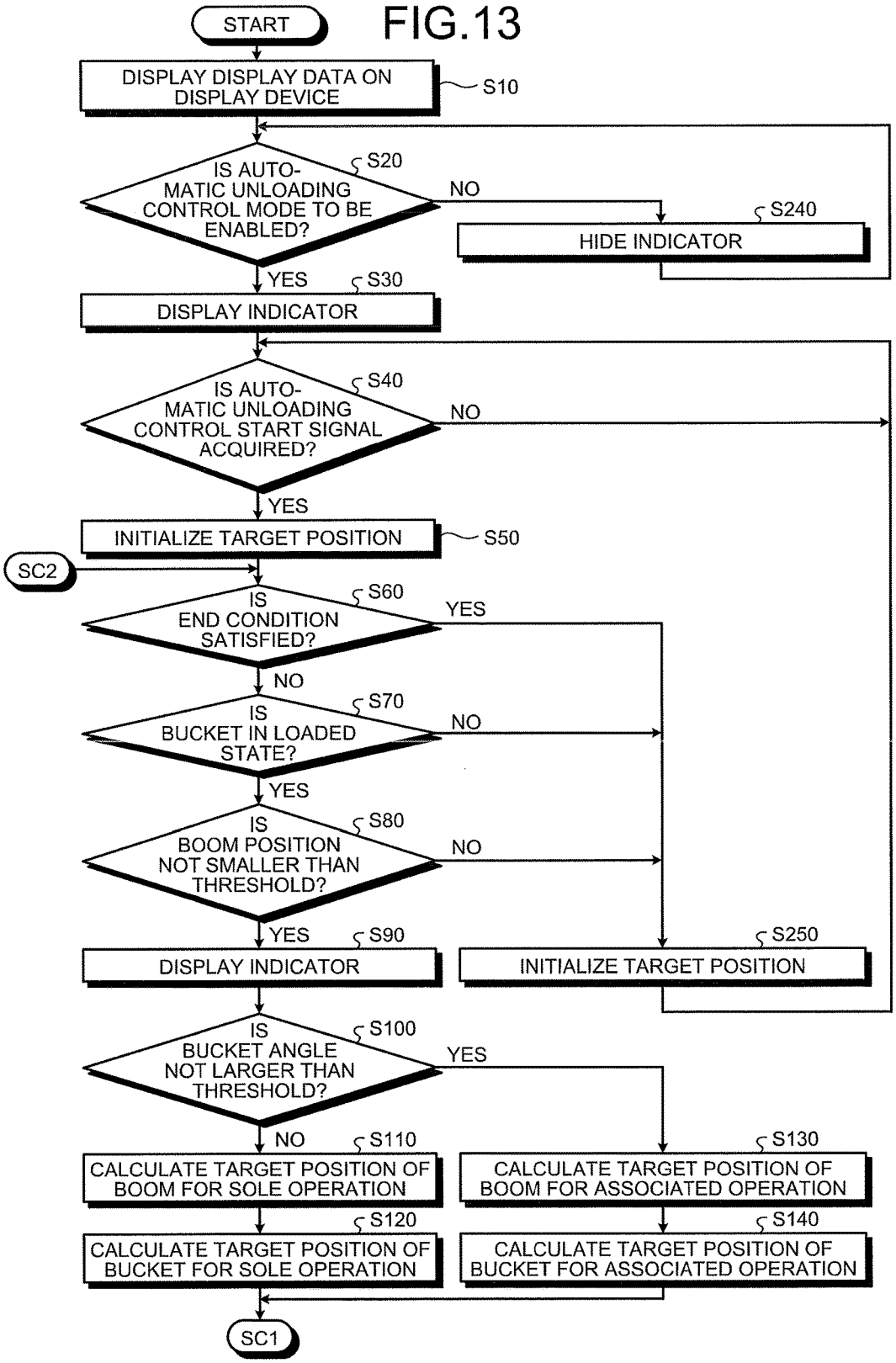
FIG.13
START
DISPLAY DISPLAY DATA ON DISPLAY DEVICE
S10
IS AUTO-MATIC UNLOADING CONTROL MODE TO BE ENABLED?
S20
NO
HIDE INDICATOR
S240
YES
DISPLAY INDICATOR
S30
IS AUTO-MATIC UNLOADING CONTROL START SIGNAL ACQUIRED?
S40
NO
YES
INITIALIZE TARGET POSITION
S50
SC2
IS END CONDITION SATISFIED?
S60
YES
NO
IS BUCKET IN LOADED STATE?
S70
NO
YES
IS BOOM POSITION NOT SMALLER THAN THRESHOLD?
S80
NO
YES
DISPLAY INDICATOR
S90
INITIALIZE TARGET POSITION
S250
IS BUCKET ANGLE NOT LARGER THAN THRESHOLD?
S100
YES
NO
CALCULATE TARGET POSITION OF BOOM FOR SOLE OPERATION
S110
CALCULATE TARGET POSITION OF BOOM FOR ASSOCIATED OPERATION
S130
CALCULATE TARGET POSITION OF BUCKET FOR SOLE OPERATION
S120
CALCULATE TARGET POSITION OF BUCKET FOR ASSOCIATED OPERATION
S140
SC1

LOADER CONTROL SYSTEM AND LOADER CONTROL METHOD

FIELD

The present invention relates to a loader control system and a loader control method.

BACKGROUND

Loaders for loading soil on carrier vehicles operates at construction sites. Wheel loaders are known as one type of loaders. A wheel loader includes a work machine having a boom and a bucket, unload soil shoveled with the bucket into a vessel of a dump truck, which is one type of carrier vehicles. The operator of the wheel loader carries out unloading operation of unloading soil on the bucket into a vessel by manipulating a control lever to adjust the position of the boom and the angle of the bucket. Patent Literature 1 discloses a technology for controlling a boom cylinder and a bucket cylinder so as to prevent soil from dropping out of a bucket.

CITATION LIST

Patent Literature

Patent Literature 1: JP 2009-052287 A

SUMMARY

Technical Problem

As the unloading operation with the wheel loader progresses, the soil in the vessel becomes gradually higher. Thus, if the unloading operation is continued with the boom positioned at a low position, the bucket and the soil in the vessel will eventually come into contact with each other, which may result in difficulty in smooth unloading operation. On the other hand, if the unloading operation is carried out with the boom positioned at a high position, soil falls into the vessel from a high position, which causes a great impact force on the dump truck. If a great impact force is exerted on the dump truck, at least part of the dump truck may be damaged or the operator of the dump truck may be made uncomfortable. A skilled operator who is used to driving a wheel loader is able to manipulate the control lever so that the boom is lifted up while the bucket is in dumping movement. Thus, a wheel loader operated by a skilled operator can carry out smooth unloading operation depending on the height of soil in the vessel. It is, however, difficult for an unskilled operator who is not used to driving a wheel loader to manipulate the control lever so that the boom is lifted up while the bucket is in dumping movement. It is thus difficult for a wheel loader operated by an unskilled operator to carry out smooth unloading operation by adjusting the height of the boom to the height of soil in the vessel.

Aspects of the present invention aim at providing a loader control system and a loader control method capable of smoothly carrying out unloading operation.

Solution to Problem

According to a first aspect of the present invention, a loader control system, comprises: a boom position calculation unit configured to calculate a position of a boom rotatably supported by a vehicle body of a loader; a bucket attitude calculation unit configured to calculate an attitude of a bucket rotatably supported by the boom; a determination unit configured to determine whether or not the attitude satisfies a predetermined condition on a basis of the attitude and a reference attitude of the bucket in dumping movement; and a work machine control unit configured to cause the bucket to carry out the dumping movement, and output a control signal to cause the boom to carry out lifting movement when the attitude is determined to satisfy the predetermined condition.

According to a second aspect of the present invention, a loader control method comprises: calculating an attitude of a bucket rotatably supported by a boom in dumping movement of the bucket; and causing the boom to carry out lifting movement when the attitude satisfies a predetermined condition.

Advantageous Effects of Invention

According to the aspects of the present invention, a loader control system and a loader control method capable of smoothly carrying out unloading operation are provided.

BRIEF DESCRIPTION OF DRAWINGS

FIG. 13 is a flowchart illustrating an example of a loader control method according to the embodiment.

DESCRIPTION OF EMBODIMENTS

An embodiment according to the present invention is hereinafter described with reference to the drawings; however, the present invention is not limited to this. Components of the embodiment hereinafter described may be appropriately combined. There is a case in which a part of the components is not used.

[Loader]

Figure 1:
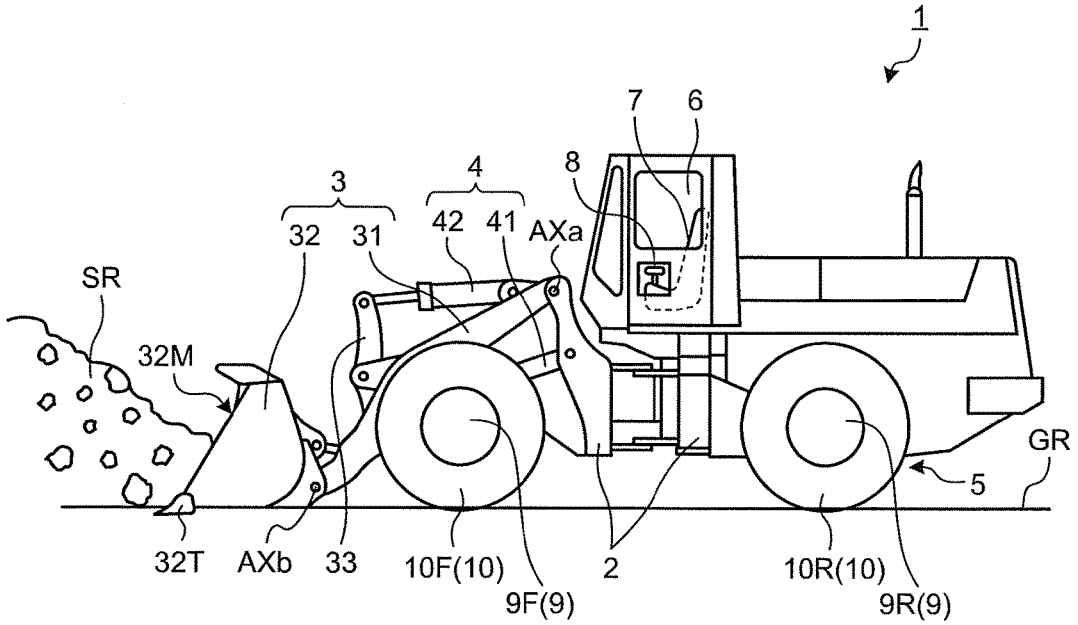
FIG. 1 is a side view schematically illustrating an example of a loader according to an embodiment.

FIG. 1 is a side view schematically illustrating an example of a loader 1 according to the present embodiment. In the present embodiment, an example in which the loader 1 is a wheel loader will be described. The wheel loader 1 is a construction machine for loading soil SR shoveled with a bucket 32 into a vessel of a dump truck.

As illustrated in FIG. 1, the wheel loader 1 includes a vehicle body 2, a work machine 3 supported by the vehicle body 2, hydraulic cylinders 4 for driving the work machine 3, and a traveling device 5 capable of supporting and moving with the vehicle body 2.

The vehicle body 2 includes a front part, a rear part, and a curving part connecting the front part with the rear part. The vehicle body 2 also supports the work machine 3. The vehicle body 2 is provided with a cab 6. A seat 7 and a control lever 8 are provided in the cab 6. An operator of the wheel loader 1 sits on the seat 7 and manipulates the control lever 8.

The traveling device 5 includes four wheels 9. Each of the four wheels 9 is equipped with a tire 10. The tires 10 are in contact with the ground GR. The wheel loader 1 travels by the rotation of the wheels 9.

In the following description, positional relationship of units is described by using terms such as a vertical direction, a lateral direction, and a longitudinal direction. A vertical direction refers to a direction orthogonal to ground contact areas of the tires 10. The vertical direction is synonymous with the height direction orthogonal to the ground contact areas of the tires 10. A lateral direction refers to a direction parallel to rotation axes of the wheels 9 of the wheel loader 1. The lateral direction is synonymous with a vehicle width direction of the wheel loader 1. A longitudinal direction refers to a direction orthogonal to the lateral direction and the vertical direction. The longitudinal direction is synonymous with a traveling direction of the wheel loader 1.

An upward direction refers to one direction in the vertical direction, which is a direction away from the ground contact areas of the tires 10. A downward direction refers to a direction opposite to the upward direction in the vertical direction, which is a direction approaching the ground contact areas of the tires 10. A leftward direction refers to one direction in the lateral direction, which is a direction to the left relative to the operator of the wheel loader 1 sitting on the seat 7. A rightward direction refers to a direction opposite to the leftward direction in the lateral direction, which is a direction to the right relative to the operator of the wheel loader 1 sitting on the seat 7. A forward direction refers to one direction in the longitudinal direction, which is a direction from the seat 7 toward the work machine 3. A rearward direction refers to a direction opposite to the forward direction in the longitudinal direction, which is a direction from the work machine 3 toward the seat 7.

An upper part refers to a part on an upper side of a member or a space in the vertical direction, which is a part away from the ground contact areas of the tires 10. A lower part refers to a part on a lower side of a member or a space in the vertical direction, which is a part close to the ground contact areas of the tires 10. A left part refers to a part on a left side of a member or a space relative to the operator of the wheel loader 1 sitting on the seat 7. A right part refers to a part on a right side of a member or a space relative to the operator of the wheel loader 1 sitting on the seat 7. A front part refers to a part on a front side of a member or a space in the longitudinal direction. A rear part refers to a part on a rear side of a member or a space in the longitudinal direction.

The wheels 9 include front wheels 9F provided on the front part of the vehicle body 2, and rear wheels 9R provided on the rear part of the vehicle body 2. The tires 10 include front tires 10F mounted on the front wheels 9F, and rear tires 10R mounted on the rear wheels 9R. The vehicle body 2 has the curving part between the front wheels 9F and the rear wheels 9R. The wheel loader 1 is steered by curving of the curving part of the vehicle body 2.

The work machine 3 is supported by the front part of the vehicle body 2. The work machine 3 includes a boom 31 coupled to the vehicle body 2, and a bucket 32 coupled to the boom 31.

The boom 31 is rotatably supported by the front part of the vehicle body 2. The boom 31 is rotatable about a boom rotation axis AXa being a fulcrum. The boom rotation axis AXa extends in the vehicle width direction. The boom 31 includes a base end and a distal end. The base end of the boom 31 is coupled to the front part of the vehicle body 2. The bucket 32 is coupled to the distal end of the boom 31.

The bucket 32 is rotatably supported by the distal end of the boom 31. The bucket 32 is rotatable about a bucket rotation axis AXb being a fulcrum. The bucket rotation axis AXb extends in the vehicle width direction. The bucket 32 includes an opening 32M and a blade 32T. The bucket 32 shovels soil SR. The wheel loader 1 unloads the soil SR shoveled with the bucket 32 into a vessel of a dump truck. The soil SR unloaded from the bucket 32 is loaded into the vessel of the dump truck.

The hydraulic cylinders 4 include a boom cylinder 41 for driving the boom 31, and a bucket cylinder 42 for driving the bucket 32.

The boom cylinder 41 is provided between the vehicle body 2 and the boom 31. Specifically, one end of the boom cylinder 41 is coupled to the front part of the vehicle body 2, and the other end of the boom cylinder 41 is coupled to the boom 31. The boom 31 turns about the boom rotation axis AXa being the fulcrum by extension/contraction of the boom cylinder 41.

The bucket cylinder 42 is provided between the vehicle body 2 and a bell crank 33. Specifically, one end of the bucket cylinder 42 is coupled to the vehicle body 2, and the other end of the bucket cylinder 42 is coupled to the bell crank 33. One end of the bell crank 33 is coupled to the bucket cylinder 42, and the other end of the bell crank 33 is coupled to the bucket 32 via a bucket link 34. The bucket 32 turns about the bucket rotation axis AXb by extension/contraction of the bucket cylinder 42.

The control lever 8 is manipulated by the operator. At least one of the boom cylinder 41 and the bucket cylinder 42 is driven by manipulation of the control lever 8. The operator in the cab 6 manipulates the control lever 8 to extend or contract at least one of the boom cylinder 41 and the bucket cylinder 42.

[Work Machine]

Figure 2:
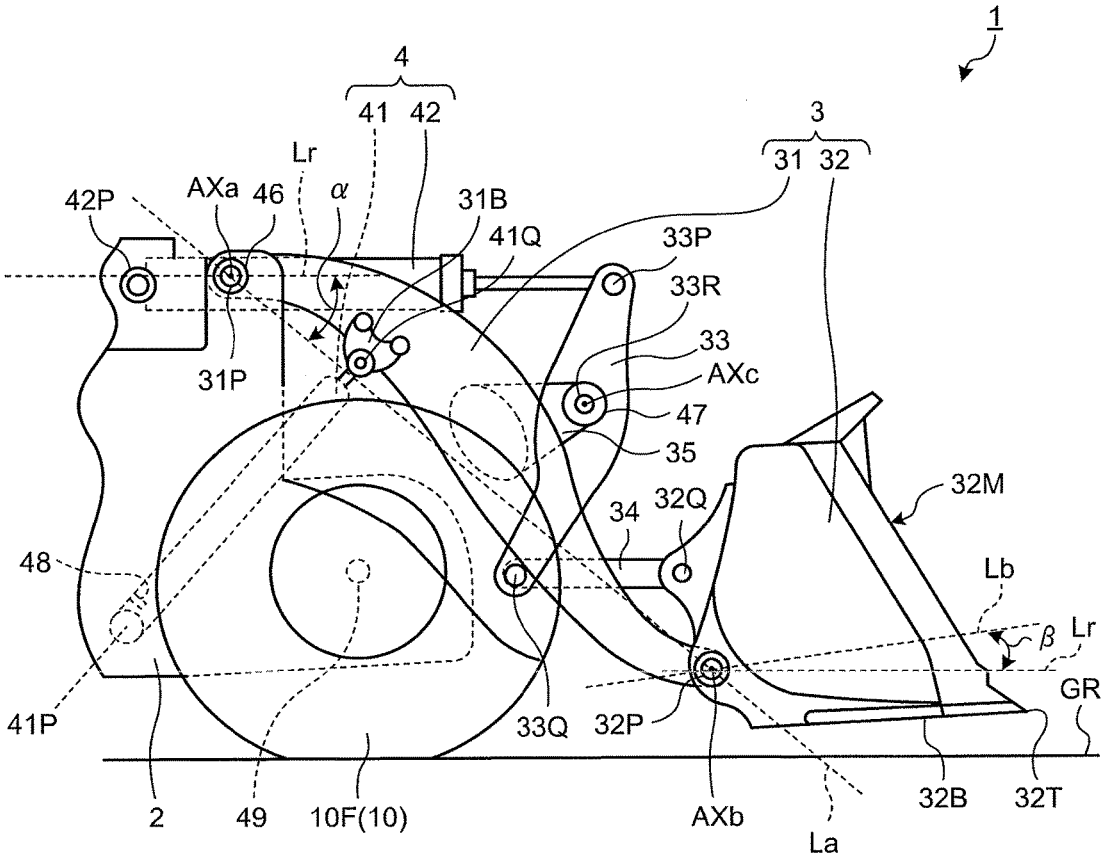
FIG. 2 is a diagram schematically illustrating an example of a work machine according to the embodiment.

FIG. 2 is a diagram schematically illustrating an example of the work machine 3 according to the present embodiment. As illustrated in FIG. 2, the base end of the boom 31 of the work machine 3 is coupled to the front part of the vehicle body 2 with a coupling pin 31P. The coupling pin 31P includes the boom rotation axis AXa. The boom 31 is coupled to the vehicle body 2 rotatable about the boom rotation axis AXa being the fulcrum. A bracket 31B is provided at an intermediate part of the boom 31.

One end of the boom cylinder 41 is coupled to the front part of the vehicle body 2 with a coupling pin 41P. The other end of the boom cylinder 41 is coupled to the bracket 31B with a coupling pin 41Q. Thus, the distal end of the boom cylinder 41 is coupled to the boom 31 via the bracket 31B.

The boom 31 turns about the boom rotation axis AXa by extension/contraction of the boom cylinder 41. The turning of the base end of the boom 31 about the boom rotation axis AXa being a fulcrum causes the distal end of the boom 31 to move in the vertical direction.

The bucket 32 is coupled to the distal end of the boom 31 with a coupling pin 32P. The coupling pin 32P includes the bucket rotation axis AXb. The bucket 32 is coupled to the boom 31 rotatably about the bucket rotation axis AXb being the fulcrum.

One end of the bucket cylinder 42 is coupled to the front part of the vehicle body 2 with a coupling pin 42P. The other end of the bucket cylinder 42 is coupled to one end of the bell crank 33 with a coupling pin 33P. The other end of the bell crank 33 is coupled to one end of the bucket link 34 with a coupling pin 33Q. The other end of the bucket link 34 is coupled to the bucket 32 with a coupling pin 32Q.

A supporting member 35 is provided at an intermediate part of the boom 31. The supporting member 35 supports the bell crank 33. An intermediate part of the bell crank 33 is coupled to the supporting member 35 with a coupling pin 33R. The coupling pin 33R includes a bell crank rotation axis AXc. The bell crank 33 turns about the bell crank rotation axis AXc being a fulcrum. The bell crank rotation axis AXc extends in the vehicle width direction.

The extension/contraction of the bucket cylinder 42 causes the bell crank 33 to turn about the bell crank rotation axis AXc being the fulcrum, and the bucket 32 to turn about the bucket rotation axis AXb being the fulcrum. As the bucket 32 turns about the bucket rotation axis AXb being the fulcrum, the angle of the bucket 32 around the bucket rotation axis AXb changes.

As the bucket cylinder 42 contracts, the bell crank 33 turns about the bell crank rotation axis AXc being the fulcrum in such a manner that one end of the bell crank 33 moves rearward while the other end of the bell crank 33 moves forward. As the other end of the bell crank 33 moves forward, the bucket 32 is pushed forward by the bucket link 34. As the bucket 32 is pushed forward by the bucket link 34, the bucket 32 carries out dumping movement.

As the bucket cylinder 42 extends, the bell crank 33 turns about the bell crank rotation axis AXc being the fulcrum in such a manner that one end of the bell crank 33 moves forward while the other end of the bell crank 33 moves rearward. As the other end of the bell crank 33 moves rearward, the bucket 32 is pulled rearward by the bucket link 34. As the bucket 32 is pulled rearward by the bucket link 34, the bucket 32 carries out tilting movement.

The dumping movement of the bucket 32 refers to turning operation of the bucket 32 in such a manner that the opening 32M faces down and the blade 32T comes closer to the ground GR. The tilting movement of the bucket 32 refers to turning operation of the bucket 32 in such a manner that the opening 32M faces up and the blade 32T goes away from the ground GR. The dumping movement of the bucket 32 causes soil SR shoveled by the bucket 32 to be unloaded from the bucket 32. The tilting movement of the bucket 32 causes the bucket 32 to shovel soil SR.

[Sensors] As illustrated in FIG. 2, the wheel loader 1 includes a boom angle sensor 46 to detect a boom angle $\alpha$, and a bucket angle sensor 47 to detect a bucket angle $\beta$.

In the present embodiment, the boom angle $\alpha$ refers to an angle between a reference line Lr orthogonal to the boom rotation axis AXa and parallel to the ground contact areas of the tires 10 and a line La connecting the boom rotation axis AXa and the bucket rotation axis AXb within a plane orthogonal to the boom rotation axis AXa.

In other words, the boom angle $\alpha$ refers to the angle of the boom 31 with respect to the reference line Lr in the present embodiment. When the boom 31 is lowered and the line La is located closer to the ground GR than the reference line Lr is, the boom angle $\alpha$ has a negative value. When the line La and the reference line Lr are coincident, the boom angle $\alpha$ is 0[°]. When the boom 31 is lifted and the line La is farther from the ground GR than the reference line Lr is, the boom angle $\alpha$ has a positive value. As the boom 31 is lifted, the boom angle $\alpha$ becomes larger, and as the boom 31 is lowered, the boom angle $\alpha$ is smaller.

In the present embodiment, the bucket angle $\beta$ refers to an angle between a reference line Lr orthogonal to the bucket rotation axis AXb and parallel to the ground contact areas of the tires 10 and a line Lb orthogonal to the bucket rotation axis AXb and parallel to a bottom surface 32B of the bucket 32 within a plane orthogonal to the bucket rotation axis AXb.

In other words, the bucket angle $\beta$ refers to the angle of the bucket 32 with respect to the reference line Lr in the present embodiment. When the bucket 32 carries out the dumping movement and the line Lb is located closer to the ground GR than the reference line Lr is, the bucket angle $\beta$ has a negative value. When the line Lb and the reference line Lr are coincident, the bucket angle $\beta$ is 0[°]. When the bucket 32 carries out the tilting movement and the line Lb is farther from the ground GR than the reference line Lr is, the bucket angle $\beta$ has a positive value. When the bucket 32 carries out the tilting movement, the bucket angle $\beta$ becomes larger, and when the bucket 32 carries out the dumping movement, the bucket angle $\beta$ becomes smaller.

In the present embodiment, the reference line Lr is assumed to be parallel to a horizontal plane. Alternatively, the reference line Lr may be inclined to the horizontal plane.

The boom angle sensor 46 is provided at the coupling pin 31P including the boom rotation axis AXa. The bucket angle sensor 47 is provided at the coupling pin 33R including the bell crank rotation axis AXc. The bucket angle sensor 47 detects the attitude of the bell crank 33 so as to detect the attitude of the bucket 32. The attitude of the bucket 32 includes the bucket angle $\beta$. In the present embodiment, the boom angle sensor 46 and the bucket angle sensor 47 each include a potentiometer.

The wheel loader 1 also includes a boom cylinder pressure sensor 48 to detect the pressure of hydraulic fluid in the boom cylinder 41, and a speed sensor 49 to detect the traveling speed of the traveling device 5.

The boom cylinder pressure sensor 48 detects a bottom pressure of hydraulic fluid with which the boom cylinder 41 is filled. The bottom pressure of the boom cylinder 41 and the total weight of the bucket 32 are correlated with each other. Specifically, as the weight of soil contained in the bucket 32 is larger, the bottom pressure of the boom cylinder 41 becomes higher, and as the weight of soil contained in the bucket 32 is smaller, the bottom pressure of the boom cylinder 41 is lower. Correlation data indicating the relation between the bottom pressure of the boom cylinder 41 and the total weight of the bucket 32 are known data. Thus, the weight of soil contained in the bucket 32 is calculated on the basis of detection data of the boom cylinder pressure sensor 48 and the correlation data. The weight of soil contained in the bucket 32 and the weight of soil unloaded from the bucket 32 are equivalent. Thus, the weight of soil unloaded from the bucket 32 into the vessel of the dump truck is calculated on the basis of the detection data of the boom cylinder pressure sensor 48 an the correlation data. In the present embodiment, the boom cylinder pressure sensor 48 functions as a weight sensor to detect the weight of soil contained in the bucket 32 and the weight of soil unloaded from the bucket 32. In addition, the boom cylinder pressure sensor 48 also functions as a load sensing device to detect whether the bucket 32 is in an unloaded state or a loaded state. The unloaded state of the bucket 32 refers to a state in which the bucket 32 does not contain soil. The loaded state of the bucket 32 refers to a state in which the bucket 32 contains soil.

[Automatic Unloading Control]

Next, operation of the wheel loader 1 according to the present embodiment and operation of a wheel loader 1J according to a conventional example will be described.

Figure 3:
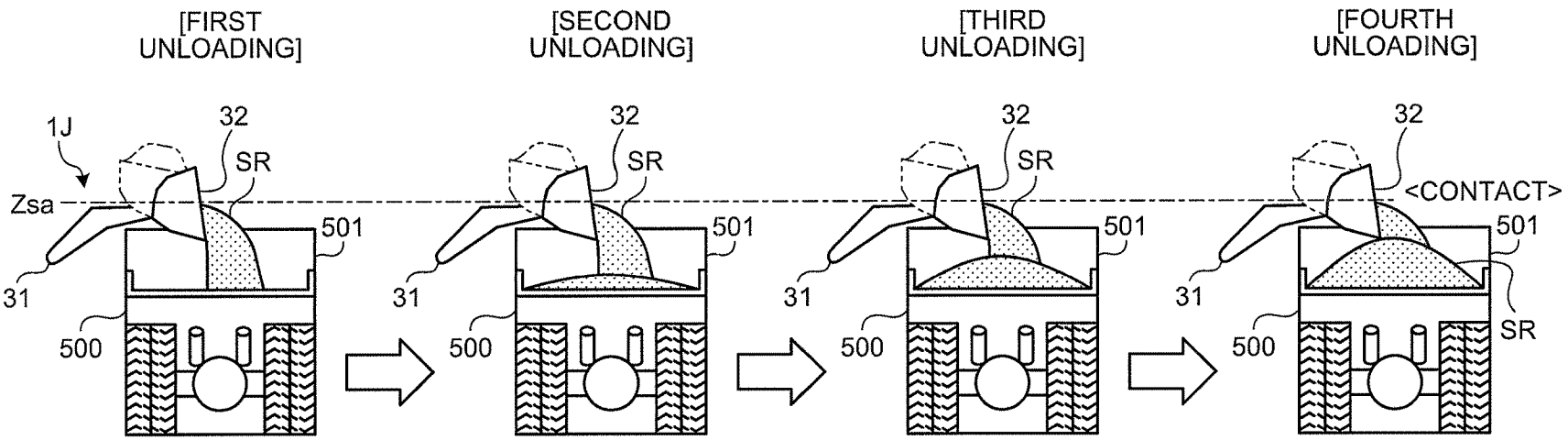
FIG. 3 is a diagram schematically illustrating an example of unloading operation with a wheel loader according to a conventional example.
Figure 4:
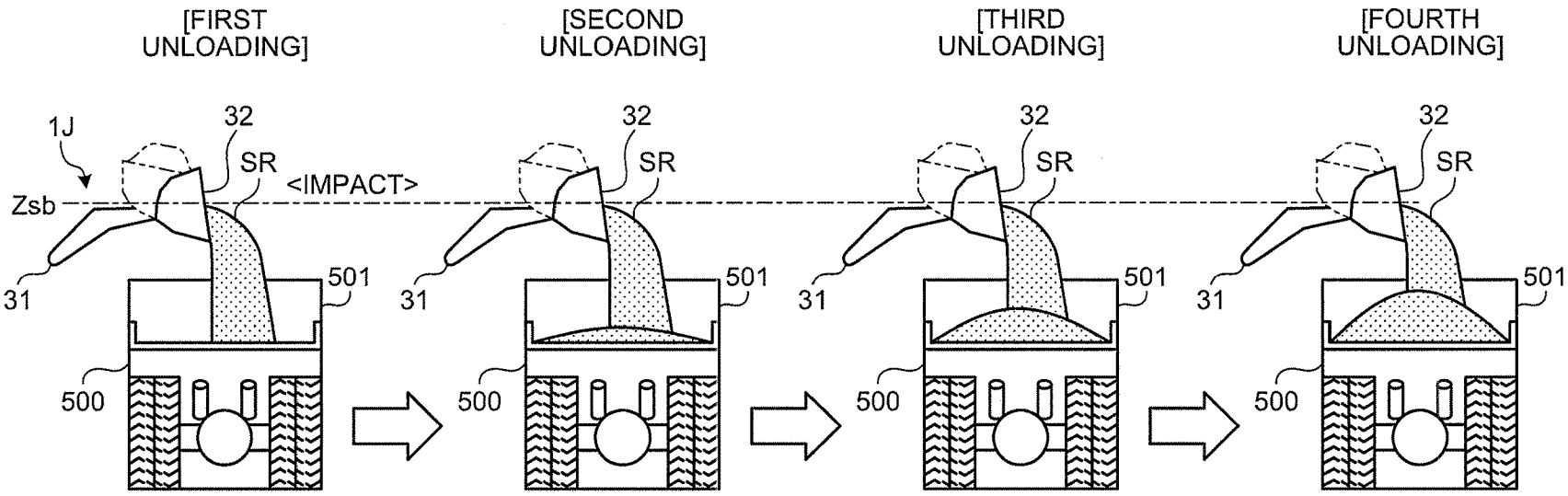
FIG. 4 is a diagram schematically illustrating an example of unloading operation with a wheel loader according to a conventional example.

The operation of the wheel loader 1J according to the conventional example will now be described. FIGS. 3 and 4 are diagrams schematically illustrating an example of unloading operation with the wheel loader 1J according to the conventional example. FIGS. 3 and 4 illustrate the unloading operation of the wheel loader 1J unloading soil SR shoveled with the bucket 32 into a vessel 501 of a dump truck 500. As illustrated in FIGS. 3 and 4, the wheel loader 1J carries out the unloading operation a plurality of times to fill the vessel 501 of the dump truck 500 with soil, for example. Before the first unloading operation, no soil SR is present in the vessel 501. As the unloading operation is repeatedly carried out, the amount of soil SR in the vessel 501 of the dump truck 500 gradually increases, and the height of the soil SR in the vessel 501 gradually becomes higher.

FIG. 3 illustrates an example in which the unloading operation is carried out a plurality of times with the distal end of the boom 31 positioned at a low position Zsa. Note that, in FIGS. 3 to 6, the attitude of the bucket 32 before the bucket 32 is caused to carry out the dumping movement is illustrated by long dashed double-short dashed lines, and the attitude of the bucket 32 during or after the dumping movement is illustrated by solid lines. The position Zsa is a position in the vertical direction (height direction) orthogonal to a plane (an horizontal plane in the present embodiment) including the reference line Lr. The state in which the position of the distal end of the boom 31 is low includes that the distance in the vertical direction between the distal end of the boom 31 and the vessel 501 is short. Thus, FIG. 3 illustrates an example in which the bucket 32 carries out the dumping movement with the distal end of the boom 31 positioned at the position Zsa close to the vessel 501 in the vertical direction. During the plurality of times of unloading operation, the position Zsa in the vertical direction of the distal end of the boom 31 is constant.

As illustrated in FIG. 3, as the unloading operation with the wheel loader 1J progresses, the soil SR in the vessel 501 becomes gradually higher. Thus, as illustrated in FIG. 3, while the bucket 32 and the soil SR in the vessel 501 are less likely to come into contact with each other during the first unloading operation, the bucket 32 and the soil SR in the vessel 501 are likely to come into contact with each other during the fourth unloading operation, for example. Specifically, as the unloading operation is continued a plurality of times with the distal end of the boom 31 positioned at the low position Zsa, the bucket 32 and the soil SR in the vessel 501 are eventually become likely to come into contact with each other during the unloading operation. When the bucket 32 and the soil SR in the vessel 501 come into contact, smooth unloading operation is likely to be difficult.

FIG. 4 illustrates an example in which the unloading operation is carried out a plurality of times with the distal end of the boom 31 positioned at a high position Zsb. The position Zsb is a position in the vertical direction (height direction) orthogonal to the plane (the horizontal plane in the present embodiment) including the reference line Lr. The state in which the position of the distal end of the boom 31 is high includes that the distance in the vertical direction between the distal end of the boom 31 and the vessel 501 is long. Thus, FIG. 4 illustrates an example in which the bucket 32 carries out the dumping movement with the distal end of the boom 31 positioned at the position Zsb away from the vessel 501 in the vertical direction. During the plurality of times of unloading operation, the position Zsb in the vertical direction of the distal end of the boom 31 is constant.

As illustrated in FIG. 4, when the unloading operation is carried out with the distal end of the boom 31 positioned at the high position Zsb, the distance between the bucket 32 and the vessel 501 is long and soil SR falls into the vessel 501 from a high position during the first unloading operation, for example. Soil SR falling from the high position Zsb into the vessel 501 causes a great impact force on the dump truck 500. When a great impact force is exerted on the dump truck 500, at least part of the dump truck 500 may be damaged or the operator of the dump truck 500 may be made uncomfortable.

Figure 5:
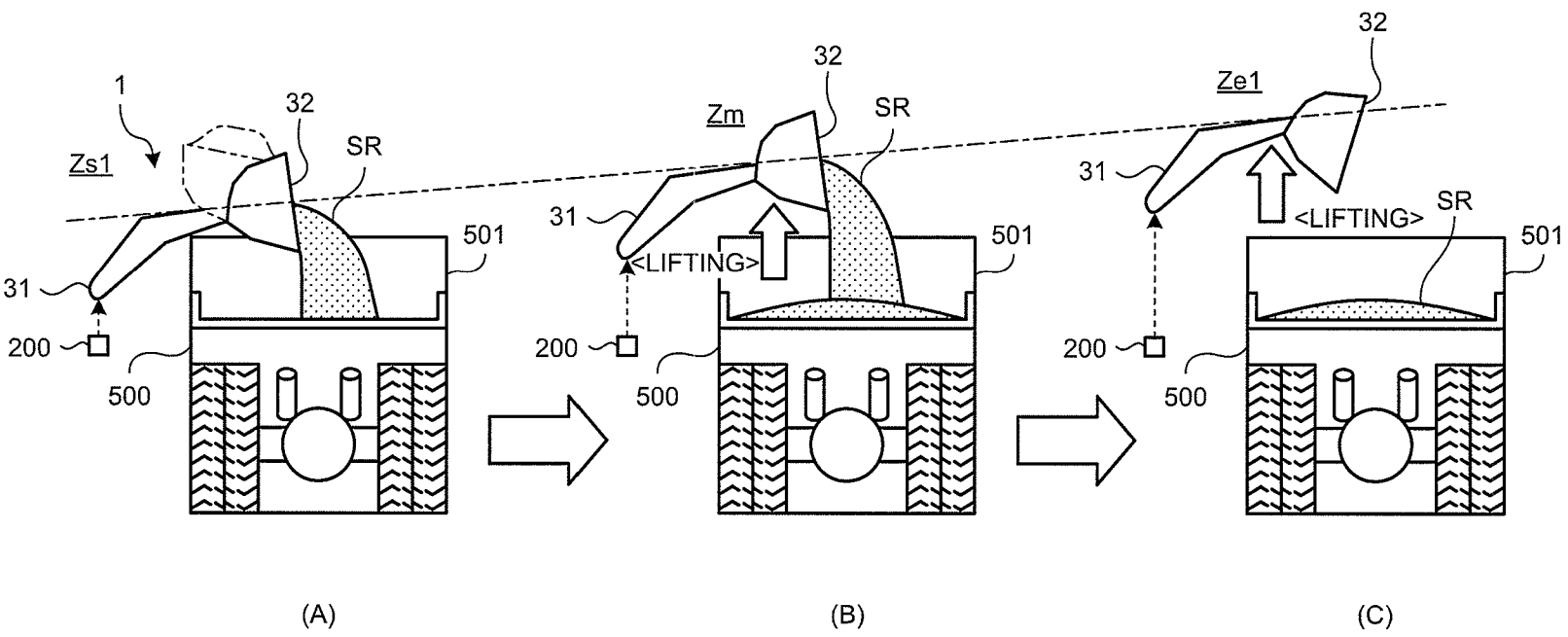
FIG. 5 is a diagram schematically illustrating an example of unloading operation with a wheel loader according to the embodiment.
Figure 6:
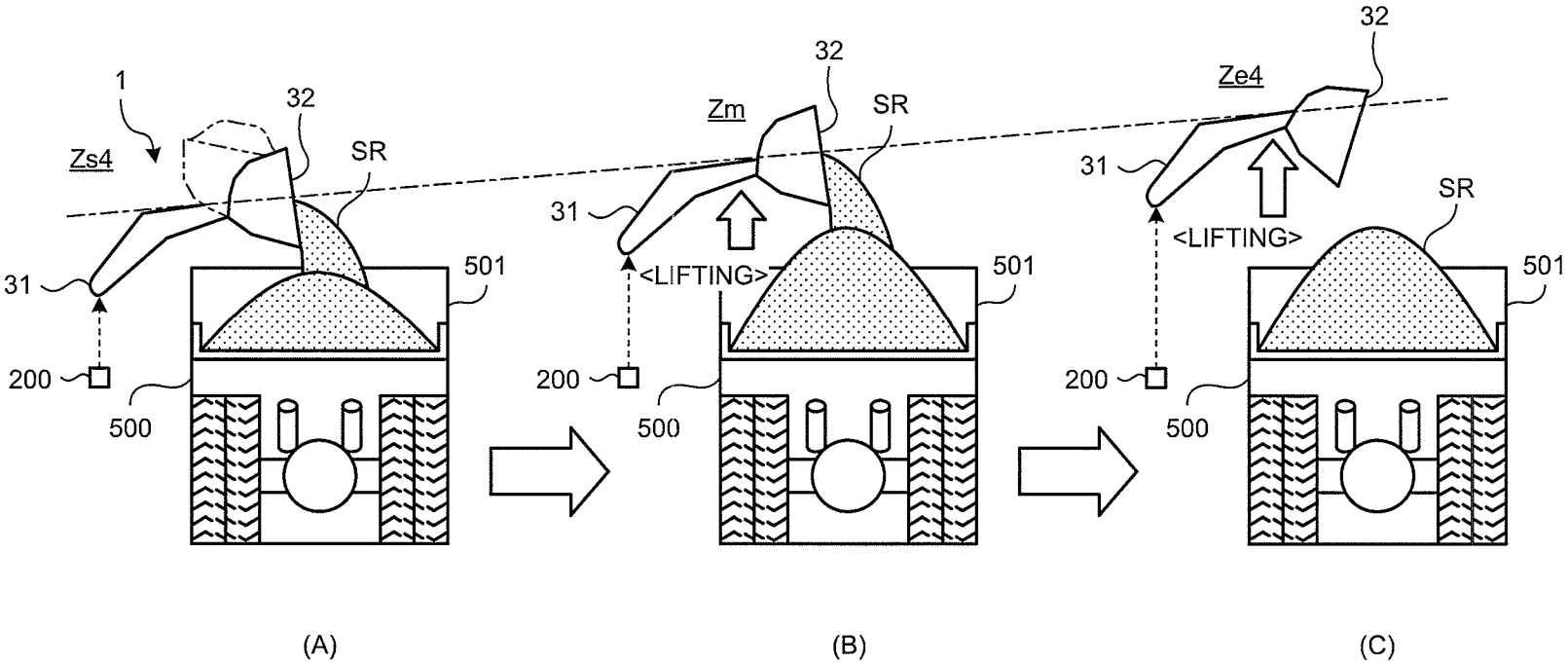
FIG. 6 is a diagram schematically illustrating an example of unloading operation with the wheel loader according to the embodiment.

Next, an example of the operation of the wheel loader 1 according to the present embodiment will be described. FIGS. 5 and 6 are diagrams schematically illustrating an example of unloading operation with the wheel loader 1 according to the present embodiment.

In the present embodiment, the wheel loader 1 carries out automatic unloading control. The automatic unloading control refers to controlling the hydraulic cylinders 4 of the wheel loader 1 so that the boom 31 is lifted upward concurrently with at least part of the dumping movement of the bucket 32 during the unloading operation. In the automatic unloading control, the hydraulic cylinders 4 are controlled on the basis of control signals output from a controller 200 mounted on the wheel loader 1.

FIG. 5 is a diagram schematically illustrating the first unloading operation among the unloading operation of the wheel loader 1 carried out according to the automatic unloading control. FIG. 6 is a diagram schematically illustrating the fourth unloading operation among the unloading operation of the wheel loader 1 carried out according to the automatic unloading control. The wheel loader 1 carries out the unloading operation a plurality of times for one dump truck 500.

As illustrated in FIG. 5(A), no soil SR is present in the vessel 501 before the first unloading operation. At the starting point of the automatic unloading control in the first unloading operation, the distal end of the boom 31 is positioned at a low position Zs1. The low position Zs1 of the distal end of the boom 31 refers to a position close to the vessel 501 in the vertical direction.

After the distal end of the boom 31 is positioned at the position Zs1, the controller 200 controls the boom cylinder 41 so that the distal end of the boom 31 is gradually lifted upward. In the example illustrated in FIG. 5, the controller 200 controls the boom cylinder 41 so that the distal end of the boom 31 starts moving upward from the position Zs1, passes through a position Zm higher than the position Zs1 as illustrated in FIG. 5(B), and then reaches a position Ze1 higher than the position Zm as illustrated in FIG. 5(C). The controller 200 also controls the bucket cylinder 42 so that the bucket 32 carries out the dumping movement concurrently with at least part of the lifting movement of the boom 31.

The position Zs1, the position Zm, and the position Ze1 are positions in the vertical direction (height direction) orthogonal to the plane (the horizontal plane in the present embodiment) including the reference line Lr. The position Zs1 is an unloading operation start position of the distal end of the boom 31 at the starting point of the first unloading operation. The position Ze1 is an unloading operation end position of the distal end of the boom 31 at the ending point of the first unloading operation.

At the starting point of the first unloading operation, since the distal end of the boom 31 is positioned at the low position Zs1, soil SR can be dropped from the low position into the vessel 501 with the distance between the bucket 32 and the vessel 501 being short. This prevents a great impact force from being exerted on the dump truck 500. Furthermore, since the lifting movement of the boom 31 is carried out concurrently with at least part of the dumping movement of the bucket 32, contact between the soil SR loaded in the vessel 501 and the bucket 32 is prevented.

As illustrated in FIG. 6(A), soil SR is present in the vessel 501 before the fourth unloading operation. At the starting point of the automatic unloading control in the fourth unloading operation, the distal end of the boom 31 is positioned at a position Zs4 higher than the position Zs1. The distance in the vertical direction between the position Zs4 of the distal end of the boom 31 and the vessel 501 is longer than the distance between the position Zs1 of the distal end of the boom 31 and the vessel 501.

After the distal end of the boom 31 is positioned at the position Zs4, the controller 200 controls the boom cylinder 41 so that the distal end of the boom 31 is gradually lifted upward. In the example illustrated in FIG. 6, the controller 200 controls the boom cylinder 41 so that the distal end of the boom 31 starts moving upward from the position Zs4, passes through a position Zm higher than the position Zs4 as illustrated in FIG. 6(B), and then reaches a position Ze4 higher than the position Zm as illustrated in FIG. 6(C). The controller 200 also controls the bucket cylinder 42 so that the boom 31 is lifted upward concurrently with at least part of the dumping movement of the bucket 32.

The position Zs4, the position Zm, and the position Ze4 are positions in the vertical direction (height direction) orthogonal to the plane (the horizontal plane in the present embodiment) including the reference line Lr. The position Zs4 is an unloading operation start position of the distal end of the boom 31 at the starting point of the fourth unloading operation. The position Ze4 is an unloading operation end position of the distal end of the boom 31 at the ending point of the fourth unloading operation.

At the starting point of the fourth unloading operation, since the distal end of the boom 31 is positioned at the position Zs4 higher than the position Zs1, the dumping movement of the bucket 32 can be carried out with the distance between the bucket 32 and the vessel 501 being long. As illustrated in FIG. 6, at the starting point of the fourth unloading operation, soil SR is already loaded in the vessel 501. Since the dumping movement of the bucket 32 is started with the distal end of the boom 31 positioned at the position Zs4, contact between the soil SR loaded in the vessel 501 and the bucket 32 is prevented. Furthermore, since the boom 31 is lifted concurrently with at least part of the dumping movement of the bucket 32, contact between the soil SR in the vessel 501 and the bucket 32 is prevented even when the soil SR loaded in the vessel 501 becomes higher.

Figure 7:
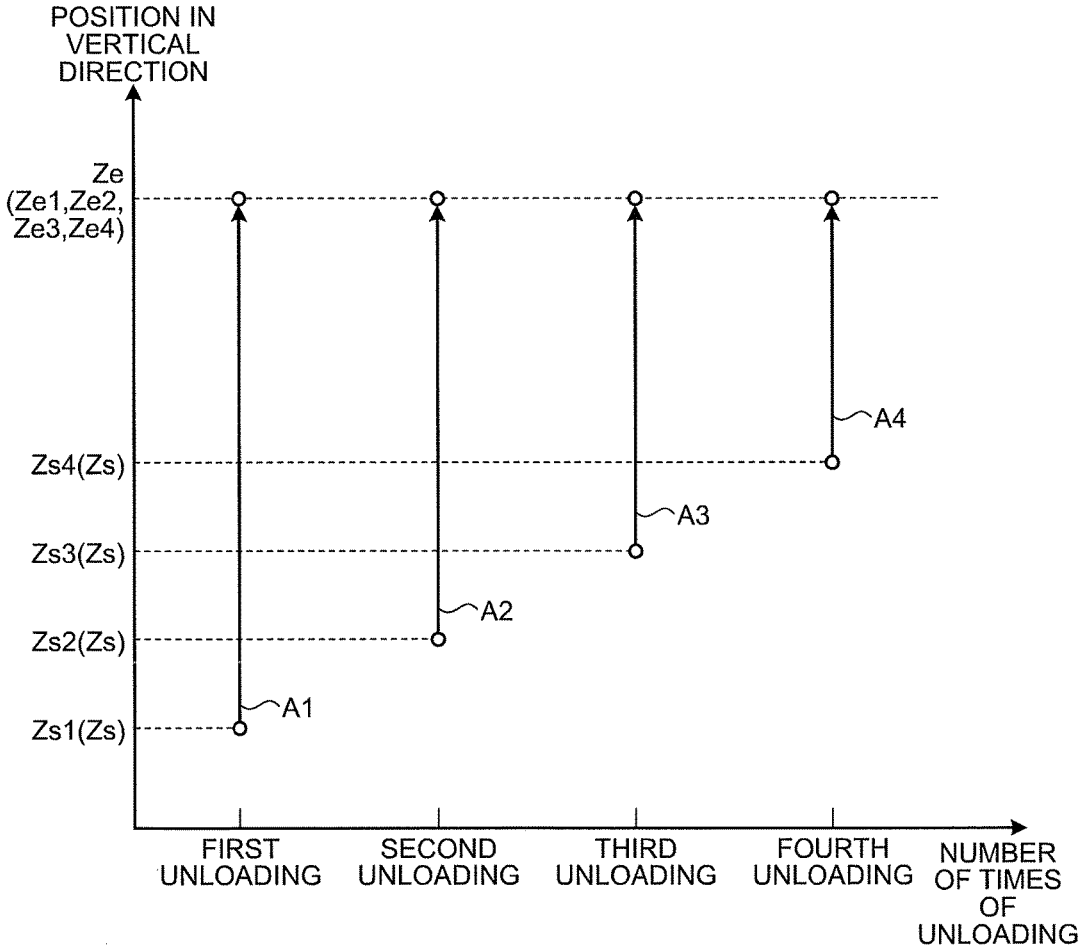
FIG. 7 is a graph schematically illustrating the relation between the number of times of unloading indicating the number of times unloading operation is carried out under automatic unloading control according to the embodiment, an unloading operation start position of a distal end of a boom, and an unloading operation end position of the distal end of the boom.
Figure 8:
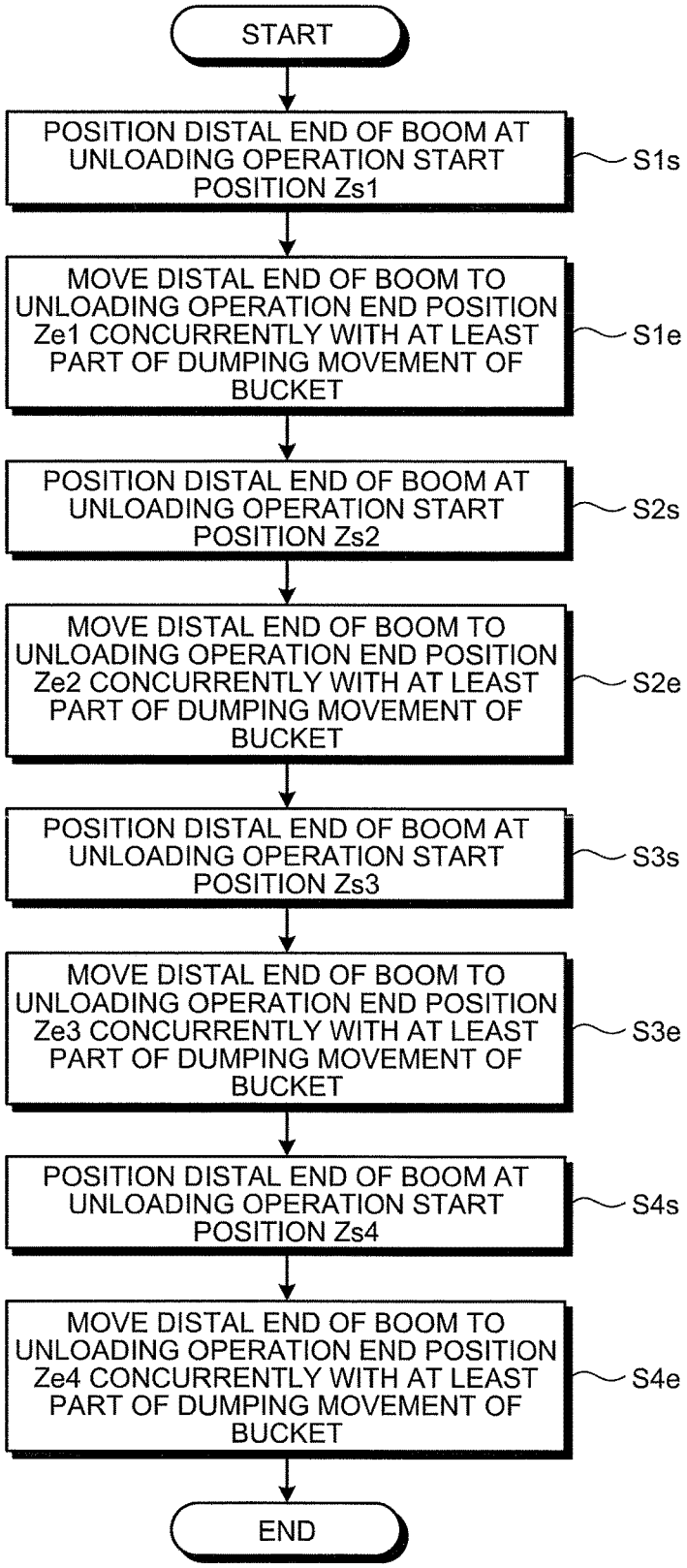
FIG. 8 is a flowchart illustrating an example of operation of a work machine 3 under automatic unloading control according to the embodiment.

FIG. 7 is a graph schematically illustrating the relation between the number of times of unloading indicating the number of times the unloading operation is carried out for the vessel 501 of one dump truck 500 under the automatic unloading control according to the present embodiment, the unloading operation start position Zs of the distal end of the boom 31, and the unloading operation end position Ze of the distal end of the boom 31. FIG. 8 is a flowchart illustrating an example of operation of the work machine 3 under the automatic unloading control according to the present embodiment.

In the example illustrated in FIGS. 7 and 8, the vessel 501 of the dump truck 500 is assumed to become fully loaded with soil SR as a result of the first unloading operation, the second unloading operation, the third unloading operation, and the fourth unloading operation.

In the present embodiment, the unloading operation start position Zs of the distal end of the boom 31 is changed on the basis of the number of times of unloading. The controller 200 counts the number of times the unloading operation of unloading soil SR from the bucket 32 into one vessel 501, into which soil is to be unloaded, is carried out. The controller 200 changes the unloading operation start position Zs of the boom 31 on the basis of the number of times of unloading.

In the first unloading operation, after the distal end of the boom 31 is positioned at the unloading operation start position Zs1 (step S1*s*), the distal end of the boom 31 is lifted upward concurrently with at least part of the dumping movement of the bucket 32 and moves to the unloading operation end position Ze1 as indicated by an arrow A1 (step S1*e*).

In the second unloading operation, after the distal end of the boom 31 is positioned at an unloading operation start position Zs2 (step S2*s*), the distal end of the boom 31 is lifted upward concurrently with at least part of the dumping movement of the bucket 32 and moves to an unloading operation end position Ze2 as indicated by an arrow A2 (step S2*e*).

In the third unloading operation, after the distal end of the boom 31 is positioned at an unloading operation start position Zs3 (step S3*s*), the distal end of the boom 31 is lifted upward concurrently with at least part of the dumping movement of the bucket 32 and moves to an unloading operation end position Ze3 as indicated by an arrow A3 (step S3*e*).

In the fourth unloading operation, after the distal end of the boom 31 is positioned at the unloading operation start position Zs4 (step S4*s*), the distal end of the boom 31 is lifted upward concurrently with at least part of the dumping movement of the bucket 32 and moves to the unloading operation end position Ze4 as indicated by an arrow A4 (step S4*e*).

In the present embodiment, as the number of times of unloading is larger, the unloading operation start position Zs of the distal end of the boom 31 is higher. Specifically, among the unloading operation start position Zs1, the unloading operation start position Zs2, the unloading operation start position Zs3, and the unloading operation start position Zs4, the unloading operation start position Zs1 is the lowest, the unloading operation start position Zs2 is the second lowest following the unloading operation start position Zs1, the unloading operation start position Zs3 is the third lowest following the unloading operation start position Zs2, and the unloading operation start position Zs4 is the highest.

In the present embodiment, the unloading operation end position Ze1, the unloading operation end position Ze2, the unloading operation end position Ze3, and the unloading operation end position Ze4 are equal. The boom 31 has a movable range in the vertical direction. The movable range of the boom 31 is determined by the movable range of the boom cylinder 41, for example. In the present embodiment, the unloading operation end position Ze1, the unloading operation end position Ze2, the unloading operation end position Ze3, and the unloading operation end position Ze4 are positions of the distal end of the boom 31 when the boom 31 has moved to the uppermost position within the movable range of the boom 31. In other words, the unloading operation end position Ze1, the unloading operation end position Ze2, the unloading operation end position Ze3, and the unloading operation end position Ze4 are the positions of the distal end of the boom 31 when the boom 31 has moved to the upper end of the movable range.

Note that the unloading operation end position Ze1, the unloading operation end position Ze2, the unloading operation end position Ze3, and the unloading operation end position Ze4 need not be the position of the distal end of the boom 31 when the boom 31 has moved to an uppermost position. Furthermore, the unloading operation end position Ze1, the unloading operation end position Ze2, the unloading operation end position Ze3, and the unloading operation end position Ze4 may be different positions. Specifically, the unloading operation end position Ze1 may be any position higher than the unloading operation start position Zs1. The unloading operation end position Ze2 may be any position higher than the unloading operation start position Zs2. The unloading operation end position Ze3 may be any position higher than the unloading operation start position Zs3. The unloading operation end position Ze4 may be any position higher than the unloading operation start position Zs4.

Figure 9:
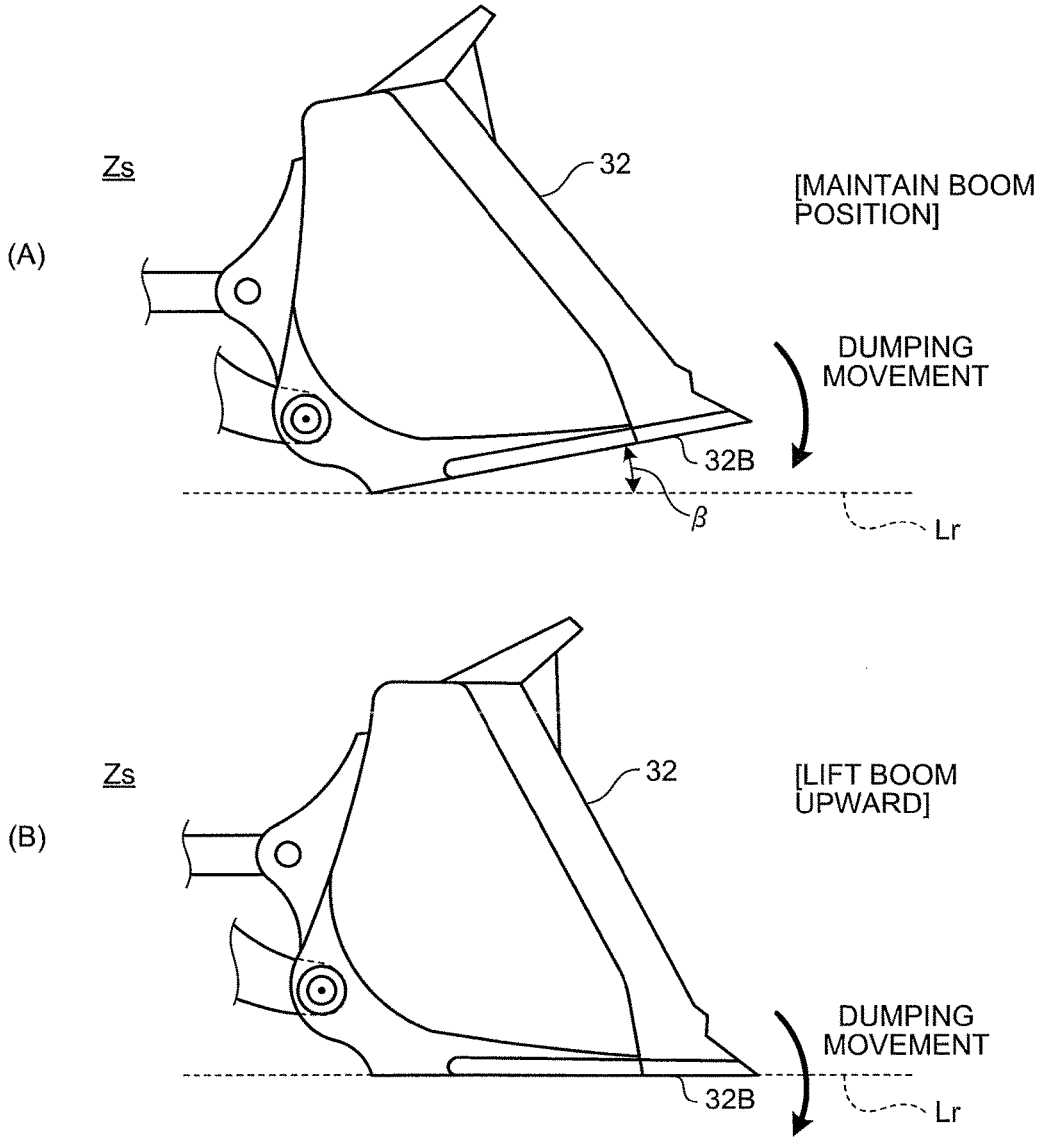
FIG. 9 is a schematic diagram for explaining the relation between dumping movement of a bucket and lifting movement of the boom under the automatic unloading control according to the embodiment.

FIG. 9 is a schematic diagram for explaining the relation between the dumping movement of the bucket 32 and the lifting movement of the boom 31 under the automatic unloading control according to the present embodiment.

When the n-th unloading operation is carried out according to the automatic unloading control, after the distal end of the boom 31 is positioned at the unloading operation start position Zs, the boom 31 is lifted upward concurrently with at least part of the dumping movement of the bucket 32 and moves to the unloading operation end position Ze. As illustrated in FIG. 9(A), after the distal end of the boom 31 is positioned at the unloading operation start position Zs, the dumping movement of the bucket 32 is started.

In the present embodiment, if the attitude of the bucket 32 does not satisfy a predetermined condition after the dumping movement of the bucket 32 is started, the boom 31 does not start the lifting movement and the position of the boom 31 in the vertical direction is maintained. In the present embodiment, the predetermined condition includes a condition that the bucket angle β is not larger than a threshold A representing a reference angle of the bucket 32. The threshold A is a threshold for the bucket angle β, and is a reference angle defined for the bucket 32. In the present embodiment, if the bucket angle β does not satisfy the condition of being not larger than the threshold A, that is, if the bucket angle β is larger than the threshold A, the boom 31 does not start the lifting movement and the distal end of the boom 31 is maintained at the unloading operation start position Zs during the dumping movement of the bucket 32.

In contrast, as illustrated in FIG. 9(B), if the vessel 32 carries out the dumping movement and the attitude of the bucket 32 satisfies the predetermined condition, that is, if the bucket angle β satisfies the condition of being not larger than the threshold A, the bucket 32 carries out the dumping movement and the boom 31 carries out the lifting movement concurrently with the dumping movement of the bucket 32.

During one dumping movement of the bucket 32, the bucket angle β changes from an angle larger than the threshold A to an angle not larger than the threshold A. Specifically, in the present embodiment, within a "first turning zone of the bucket 32" in which the bucket angle β, which is a detected angle of the bucket 32, is larger than the threshold A, which is the reference angle, the bucket 32 carries out the dumping movement with the boom 31 maintained at the unloading operation start position Zs. Furthermore, within a "second turning zone of the bucket 32" in which the bucket angle β, which is a detected angle of the bucket 32, is not larger than the threshold A, which is the reference angle, the bucket 32 carries out the dumping movement while the boom 31 is lifted upward.

In the present embodiment, the threshold A representing the reference angle is set to 0[°], for example. In the present embodiment, even after the dumping movement of the bucket 32 is started, if the boom angle β has a positive value larger than 0[°], that is, in a state in which the bottom surface 32B of the bucket 32 is above the reference line Lr, the boom 31 does not start the lifting movement and the dumping movement of the bucket 32 is carried out with the distal end of the boom 31 maintained at the unloading operation start position Zs. Alternatively, an angle other than 0[°] may be set for the threshold A representing the reference angle.

When the boom angle β not larger than 0[°], that is, in a state in which the bottom surface 32B of the bucket 32 is below the reference line Lr, the dumping movement of the bucket 32 is carried out concurrently with the lifting movement of the boom 31.

Thus, in the present embodiment, when the boom angle β is not larger than the threshold A, the lifting movement of the boom 31 and the dumping movement of the bucket 32 are carried out in conjunction with each other. When the boom angle β is larger than the threshold A, the lifting movement of the boom 31 is not carried out, and the dumping movement of the bucket 32 is carried out alone.

In the description below, the state in which the boom angle β is not larger than the threshold A and the lifting movement of the boom 31 is carried out concurrently with the dumping movement of the bucket 32 will be referred to as associated operation of the work machine 3 where appropriate, and the state in which the boom angle β is larger than the threshold A and the dumping movement of the bucket 32 is carried out without the lifting movement of the boom 31 being carried out will be referred to as sole operation of the work machine 3 where appropriate.

[Cab]

Figure 10:
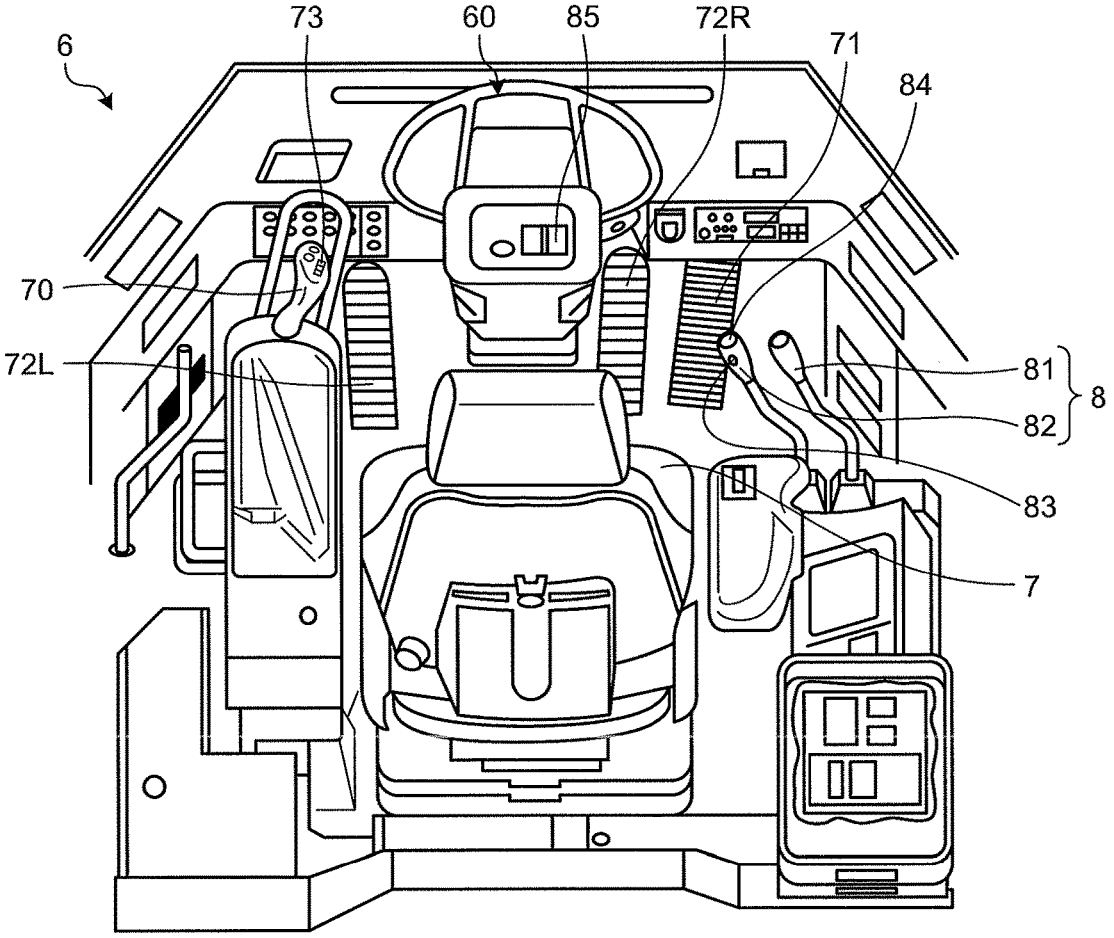
FIG. 10 is a diagram schematically illustrating an example of a cab according to the embodiment.

FIG. 10 is a diagram schematically illustrating an example of the cab 6 according to the present embodiment. As illustrated in FIG. 10, the cab 6 of the wheel loader 1 is provided with a monitor 60, the seat 7, the control lever 8 for operating the work machine 3, a steering lever 70 for steering the wheel loader 1, an accelerator pedal 71, a right brake pedal 72R, a left brake pedal 72L, and a forward/reverse switch 73.

The control lever 8 includes a boom control lever 81 for operating the boom cylinder 41, and a bucket control lever 82 for operating the bucket cylinder 42.

The operator of the wheel loader 1 sits on the seat 7 and manipulates the control lever 8. In the present embodiment, the boom control lever 81 is turned forward, so that the boom 31 is lowered. The boom control lever 81 is turned rearward, so that the boom 31 is lifted upward. The bucket control lever 82 is turned forward, so that the bucket 32 carries out the dumping movement. The bucket control lever 82 is turned rearward, so that the bucket 32 carries out the tilting movement.

The forward/reverse switch 73 is manipulated by the operator to generate a control signal to switch between forward movement and rearward movement of the wheel loader 1. When the forward/reverse switch 73 is manipulated and a control signal to move the wheel loader 1 forward is generated, the wheel loader 1 moves forward according to the operator's operation of the accelerator pedal 71. When the forward/reverse switch 73 is manipulated and a control signal to move the wheel loader 1 rearward is generated, the wheel loader 1 moves rearward according to the operator's operation of the accelerator pedal 71. The forward movement of the wheel loader 1 refers to movement of the traveling device 5 so that the front part of the vehicle body 2 to which the work machine 3 is coupled faces forward in the traveling direction. The forward movement of the wheel loader 1 refers to movement of the traveling device 5 so that the rear part of the vehicle body 2 to which the work machine 3 is not coupled faces forward in the traveling direction.

In addition, the cab 6 of the wheel loader 1 is provided with an automatic unloading control switch 83, a reset switch 84, and a positioner setting switch 85. In the present embodiment, the automatic unloading control switch 83 and the reset switch 84 are provided at the bucket control lever 82. The automatic unloading control switch 83, the reset switch 84 and the positioner setting switch 85 are manipulated by the operator of the wheel loader 1. Note that the automatic unloading control switch 83, the reset switch 84, and the positioner setting switch 85 may be provided at any positions in the cab 6 where the switches can be manipulated by the operator sitting on the seat 7.

The automatic unloading control switch 83 is manipulated by the operator to generate a start signal to start the automatic unloading control. As a result of the generation of the start signal, the automatic unloading control is started.

The reset switch 84 is manipulated by the operator to generate a reset signal to reset the unloading operation count indicating the number of times the unloading operation is carried out.

The positioner setting switch 85 is manipulated by the operator to generate a setting signal to set the unloading operation start position Zs of the distal end of the boom 31.

[Control System]

Figure 11:
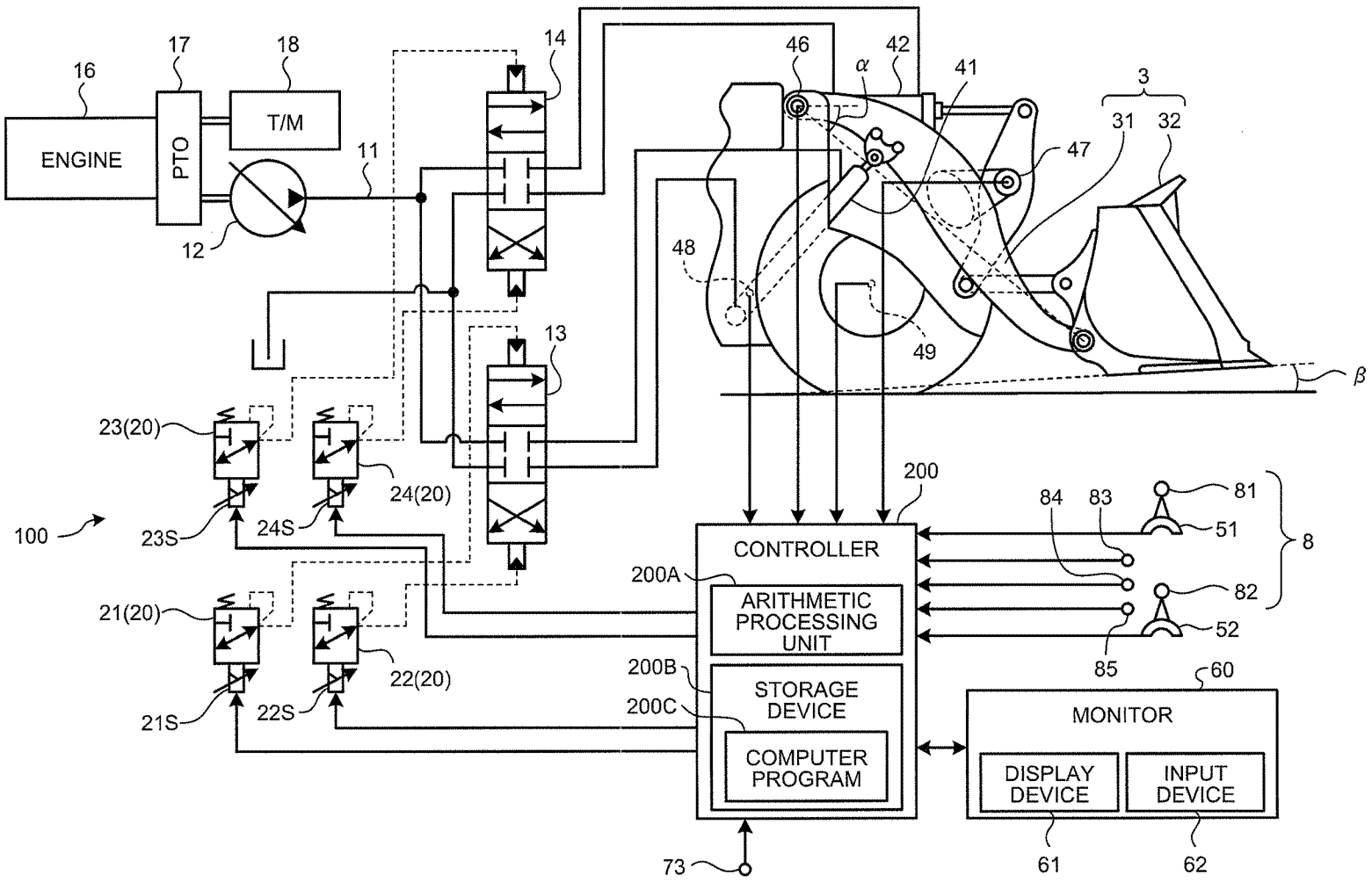
FIG. 11 is a diagram illustrating an example of a loader control system according to the embodiment.

FIG. 11 is a diagram illustrating an example of a control system 100 of the wheel loader 1 according to the present embodiment. The control system 100 is mounted on the wheel loader 1. The control system 100 controls at least the work machine 3. As illustrated in FIG. 11, the control system 100 includes a fluid passage 11, a hydraulic pump 12, a boom control valve 13, a bucket control valve 14, electromagnetic proportional control valves 20, and the controller 200.

The control system 100 also includes the boom angle sensor 46, the bucket angle sensor 47, the boom cylinder pressure sensor 48, the speed sensor 49, a first potentiometer 51, a second potentiometer 52, the forward/reverse switch 73, the automatic unloading control switch 83, the reset switch 84, the positioner setting switch 85, and the monitor 60.

The control system 100 also includes an engine 16, which is a power generation source, a power takeoff (PTO) 17 to take power from the engine 16, and a transmission 18. Power generated by the engine 16 is supplied to each of the hydraulic pump 12 and the transmission 18 via the power takeoff 17.

The hydraulic pump 12 is driven on the basis of the power supplied from the engine 16 via the power takeoff 17. The hydraulic pump 12 discharges hydraulic fluid into the fluid passage 11.

The transmission 18 transmits power supplied from the engine via the power takeoff 17 to the wheels 9. The wheels 9 rotates on the basis of the power supplied from the engine 16 via the power takeoff 17 and the transmission 18. The wheel loader 1 travels by the rotation of the wheels 9.

The fluid passage 11 is connected to a discharge port of the hydraulic pump 12. The hydraulic fluid discharged from the discharge port of the hydraulic pump 12 flows through the fluid passage 11. The fluid passage 11 is connected to each of the boom control valve 13 and the bucket control valve 14. In the present embodiment, the boom control valve 13 and the bucket control valve 14 are hydraulic pilot control valves. The boom control valve 13 is connected to the boom cylinder 41. The bucket control valve 14 is connected to the bucket cylinder 42.

The boom control valve 13 regulates the hydraulic fluid to be supplied to the boom cylinder 41. The boom control valve 13 is movable to a first position to supply the hydraulic fluid to the boom cylinder 41 so that the boom 31 is lifted upward, a second position to supply the hydraulic fluid to the boom cylinder 41 so that the boom 31 is lowered, and to a third position to supply the hydraulic fluid to the boom cylinder 41 so that the position of the boom 31 is maintained.

The bucket control valve 14 regulates the hydraulic fluid to be supplied to the bucket cylinder 42. The bucket control valve 14 is movable to a fourth position to supply the hydraulic fluid to the bucket cylinder 42 so that the bucket 32 carries out the tilting movement, a fifth position to supply the hydraulic fluid to the bucket cylinder 42 so that the bucket 32 carries out the dumping movement, and a sixth position to supply the hydraulic fluid to the bucket cylinder 42 so that the angle of the bucket 32 is maintained.

A pilot pressure receiving part of the boom control valve 13 and a pilot pressure receiving part of the bucket control valve 14 are each connected with the hydraulic pump 12 via an electromagnetic proportional control valve 20. The hydraulic pump 12 applies a pilot pressure to each of the pilot pressure receiving part of the boom control valve 13 and the pilot pressure receiving part of the bucket control valve 14 via the electromagnetic proportional control valves 20.

The electromagnetic proportional control valves 20 include a boom lowering electromagnetic proportional control valve 21, a boom lifting electromagnetic proportional control valve 22, a bucket dumping electromagnetic proportional control valve 23, and a bucket tilting electromagnetic proportional control valve 24.

The boom lowering electromagnetic proportional control valve 21 has a solenoid control part 21S. The boom lowering electromagnetic proportional control valve 21 is connected to one of the pilot pressure receiving parts of the boom control valve 13.

The boom lifting electromagnetic proportional control valve 22 has a solenoid control part 22S. The boom lifting electromagnetic proportional control valve 22 is connected to the other of the pilot pressure receiving parts of the boom control valve 13.

The bucket dumping electromagnetic proportional control valve 23 has a solenoid control part 23S. The bucket dumping electromagnetic proportional control valve 23 is connected to one of the pilot pressure receiving parts of the bucket control valve 14.

The bucket tilting electromagnetic proportional control valve 24 has a solenoid control part 24S. The bucket tilting electromagnetic proportional control valve 24 is connected to the other of the pilot pressure receiving parts of the bucket control valve 14.

The solenoid control part 21S, the solenoid control part 22S, the solenoid control part 23S, and the solenoid control part 24S are each connected to the controller 200. The controller 200 outputs a control signal to at least one of the solenoid control part 21S, the solenoid control part 22S, the solenoid control part 23S, and the solenoid control part 24S.

The boom lowering electromagnetic proportional control valve 21, the boom lifting electromagnetic proportional control valve 22, the boom control valve 13, and the boom cylinder 41 function as a boom drive unit to change the position in the vertical direction of the distal end of the boom 31. The bucket dumping electromagnetic proportional control valve 23, the bucket tilting electromagnetic proportional control valve 24, the bucket control valve 14, and the bucket cylinder 42 function as a bucket drive unit to change the angle of the bucket 32 about the bucket rotation axis AXb being the fulcrum.

The controller 200 includes a computer system. The controller 200 has an arithmetic processing unit 200A including a processor such as a central processing unit (CPU), and a storage device 200B including a volatile memory such as a read only memory (ROM) and a non-volatile memory such as a random access memory (RAM). The arithmetic processing unit 200A performs arithmetic processing according to a computer program 200C stored in the storage device 200B.

The controller 200 is connected with the boom angle sensor 46, the bucket angle sensor 47, the boom cylinder pressure sensor 48, the speed sensor 49, the first potentiometer 51, the second potentiometer 52, the forward/reverse switch 73, the automatic unloading control switch 83, the reset switch 84, the positioner setting switch 85, and the monitor 60.

Detection data of the boom angle sensor 46, detection data of the bucket angle sensor 47, detection data of the boom cylinder pressure sensor 48, and detection data of the speed sensor 49 are output to the controller 200.

The first potentiometer 51 detects the amount of manipulation of the boom control lever 81. The second potentiometer 52 detects the amount of manipulation of the bucket control lever 82. Detection data of the first potentiometer 51 are output to the controller 200. Detection data of the second potentiometer 52 are output to the controller 200.

A control signal generated as a result of manipulation of the forward/reverse switch 73, a start signal generated as a result of manipulation of the automatic unloading control switch 83, a reset signal generated as a result of manipulation of the reset switch 84, and a setting signal generated as a result of manipulation of the positioner setting switch 85 are output to the controller 200.

The monitor 60 includes a display device 61 and an input device 62. The display device 61 includes a flat panel display such as a liquid crystal display (LCD) or an organic electroluminescence display (OELD). The input device 62 includes at least one of a switch button, a computer keyboard, a mouse, and a touch sensor provided on a display screen of the display device 61. The controller 200 outputs display data to the display device 61. The display device 61 displays the display data output from the controller 200 on the display screen. The input device 62 is manipulated by the operator of the wheel loader 1. As a result of the operator's manipulation, the input device 62 generates input data and outputs the input data to the controller 200.

The first potentiometer 51 detects the amount of manipulation of the boom control lever 81 manipulated by the operator. Detection data of the first potentiometer 51 are output to the controller 200. The controller 200 outputs a control signal for driving the boom cylinder 41 to at least one of the solenoid control part 21S of the boom lowering electromagnetic proportional control valve 21 and the solenoid control part 22S of the boom lifting electromagnetic proportional control valve 22 on the basis of the detection data of the first potentiometer 51. As a result of the control signal being output to at least one of the solenoid control part 21S and the solenoid control part 22S, the boom cylinder 41 extends or contracts. The extension/contraction of the boom cylinder 41 moves the distal end of the boom 31 in the vertical direction.

The second potentiometer 52 detects the amount of manipulation of the bucket control lever 82 manipulated by the operator. Detection data of the second potentiometer 52 are output to the controller 200. The controller 200 outputs a control signal for driving the bucket cylinder 42 to at least one of the solenoid control part 23S of the bucket dumping electromagnetic proportional control valve 23 and the solenoid control part 24S of the bucket tilting electromagnetic proportional control valve 24 on the basis of the detection data of the second potentiometer 52. As a result of the control signal being output to at least one of the solenoid control part 23S and the solenoid control part 24S, the bucket cylinder 42 extends or contracts. The extension/contraction of the bucket cylinder 42 causes the bucket 32 to carry out the tilting movement or the dumping movement.

[Controller]

Figure 12:
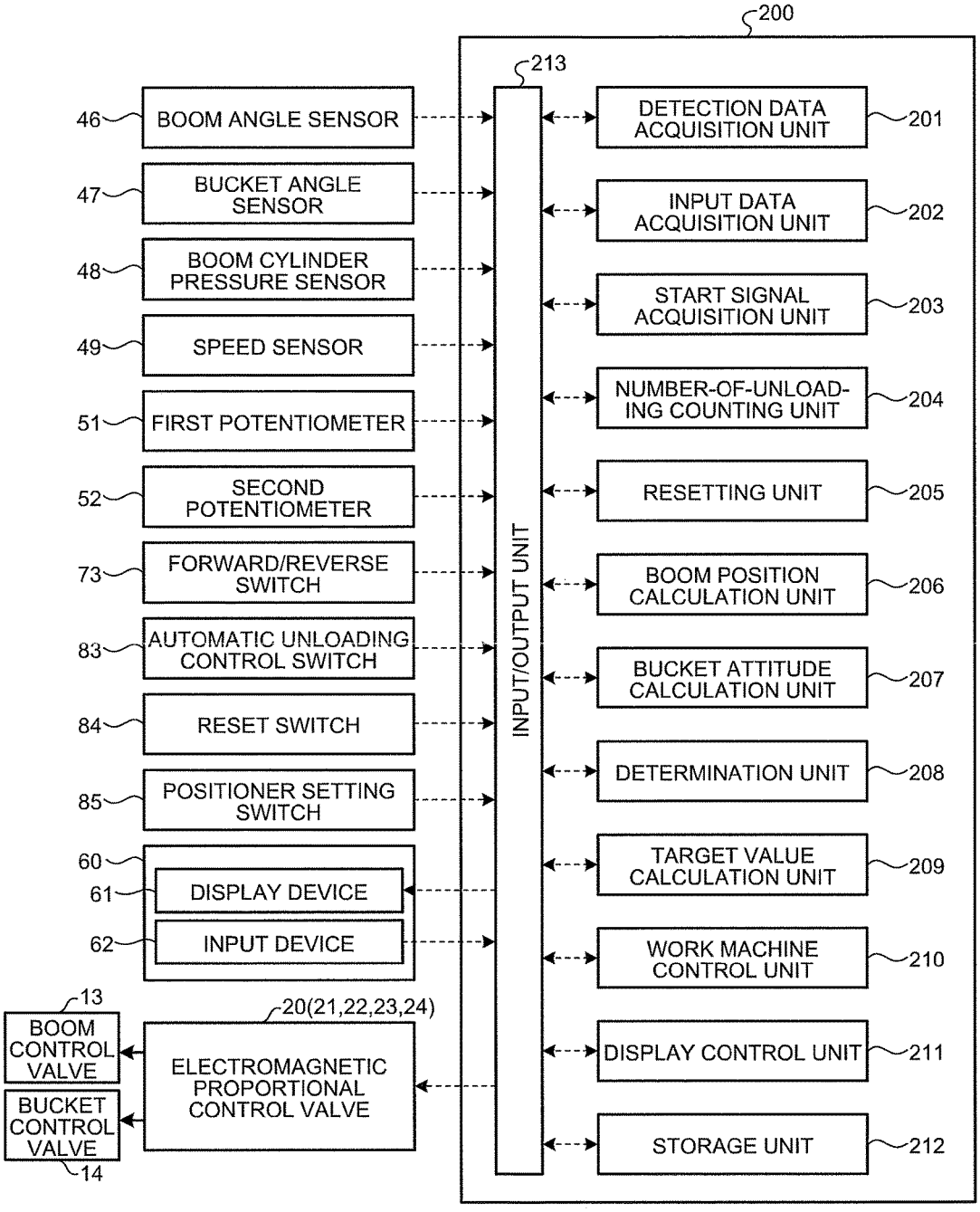
FIG. 12 is a functional block diagram illustrating an example of a controller of the loader according to the embodiment.

FIG. 12 is a functional block diagram illustrating an example of the controller 200 of the wheel loader 1 according to the present embodiment. As illustrated in FIG. 12, the controller 200 includes a detection data acquisition unit 201, an input data acquisition unit 202, a start signal acquisition unit 203, a number-of-unloading counting unit 204, a resetting unit 205, a boom position calculation unit 206, a bucket attitude calculation unit 207, a determination unit 208, a target value calculation unit 209, a work machine control unit 210, a display control unit 211, a storage unit 212, and an input/output unit 213.

The input/output unit 213 of the controller 200 is connected with the boom angle sensor 46, the bucket angle sensor 47, the boom cylinder pressure sensor 48, the speed sensor 49, the first potentiometer 51, the second potentiometer 52, the forward/reverse switch 73, the automatic unloading control switch 83, the reset switch 84, the positioner setting switch 85, the monitor 60, and the electromagnetic proportional control valves 20.

The detection data acquisition unit 201 acquires detection data of the boom angle sensor 46, detection data of the bucket angle sensor 47, detection data of the boom cylinder pressure sensor 48, detection data of the speed sensor 49, detection data of the first potentiometer 51, and detection data of the second potentiometer 52.

The input data acquisition unit 202 acquires a control signal generated as a result of manipulation of the forward/reverse switch 73 and input data generated as a result of manipulation of the input device 62.

The start signal acquisition unit 203 acquires a start signal, which is generated by the automatic unloading control switch 83 that is one type of manipulation device, instructing start of control under the automatic unloading control.

The number-of-unloading counting unit 204 counts the number of times the unloading operation of unloading soil from the bucket 32 into one vessel 501, into which soil SR is to be unloaded, is carried out. In the present embodiment, the number-of-unloading counting unit 204 counts the number of times of unloading on the basis of detection data of the boom cylinder pressure sensor 48. As described above the boom cylinder pressure sensor 48 functions as a weight sensor to detect the weight of soil contained in the bucket 32, and a load sensing device to detect whether the bucket 32 is in an unloaded state or a loaded state. The number-of-unloading counting unit 204 is capable of determining whether the bucket 32 is in an unloaded state containing no soil or in a loaded state containing soil on the basis of the detection data of the boom cylinder pressure sensor 48. The number-of-unloading counting unit 204 determines that the unloading operation is carried out once when the bucket 32 is determined to have changed from the loaded state to the unloaded state on the basis of the detection data of the boom cylinder pressure sensor 48.

The resetting unit 205 acquires a reset signal generated as a result of manipulation of the reset switch 84. Upon acquiring a reset signal, the resetting unit 205 resets the unloading operation count, indicating the number of times the unloading operation is carried out, counted by the number-of-unloading counting unit 204.

The boom position calculation unit 206 calculates the position of the boom 31 rotatably supported by the vehicle body 2 of the wheel loader 1. The boom position calculation unit 206 calculates the position of the boom 31 on the basis of the detection data of the boom angle sensor 46 and work machine data stored in the storage unit 212. The position of the boom 31 includes the position of the distal end of the boom 31 in the vertical direction, which is calculated on the basis of the detection data of the boom angle sensor 46 and the work machine data stored in the storage unit 212.

The work machine data include outer shape data and dimension data of the boom 31, for example. The work machine data are known data derived from specification data of the work machine 3, and stored in the storage unit 212. The boom position calculation unit 206 is capable of calculating the position of the distal end of the boom 31 in the vertical direction on the basis of the detection data of the boom angle sensor 46 and the work machine data stored in the storage unit 212.

The bucket attitude calculation unit 207 calculates the attitude of the bucket 32 rotatably supported by the boom 31. The bucket attitude calculation unit 206 calculates the attitude of the bucket 32 on the basis of the detection data of the bucket angle sensor 47 and the work machine data stored in the storage unit 212. The attitude of the bucket 32 includes the bucket angle β, which is a detected angle calculated on the basis of the detection data of the attitude of the bucket 32. In the present embodiment, the attitude of the bucket 32 is calculated on the basis of the detection data of the bucket angle sensor 47 and the work machine data stored in the storage unit 212, and includes the bucket angle β which is a detected angle of the bucket 32. In addition, the attitude of the bucket 32 includes the angle and the position of the bottom surface 32B of the bucket 32 with respect to the reference line Lr.

The work machine data include outer shape data and dimension data of the bucket 32. The work machine data are known data derived from specification data of the work machine 3, and stored in the storage unit 212. The bucket attitude calculation unit 207 is capable of calculating the bucket angle β and the position of the bucket 32 in the vertical direction on the basis of the detection data of the bucket angle sensor 47 and the work machine data stored in the storage unit 212.

The determination unit 208 determines whether or not the attitude of the bucket 32 satisfies the predetermined condition on the basis of the attitude of the bucket 32 calculated by the bucket attitude calculation unit 207 and the reference angle of the bucket 32 during the dumping movement. The reference angle of the bucket 32 includes the threshold A representing the angle of a reference attitude, which is an attitude of reference of the bucket 32. The determination unit 208 determines whether or not the bucket angle β, which is a detected angle of the bucket 32, satisfies the condition of being not larger than the threshold A.

The target value calculation unit 209 calculates a target value in the automatic unloading control. In the present embodiment, the target value calculation unit 209 acquires a setting signal generated as a result of manipulation of the positioner setting switch 85. The target value calculation unit 209 sets a target position of the unloading operation start position Zs of the distal end of the boom 31 on the basis of the acquired setting signal.

Specifically, in the present embodiment, the unloading operation start position Zs is set on the basis of manipulation of the positioner setting switch 85. For example, when the operator of the wheel loader 1 manipulates the control lever 8 to place the distal end of the boom 31 at a desired position, the operator manipulates the positioner setting switch 85 to teach the unloading operation start position Zs of the distal end of the boom 31. The teaching of the unloading operation start position Zs of the distal end of the boom 31 may be performed in advance before starting the unloading operation. The unloading operation start position Zs of the distal end of the boom 31 set by the teaching is stored in the storage unit 212.

Alternatively, the target value calculation unit 209 may set a target position of the unloading operation start position Zs of the distal end of the boom 31 on the basis of outer shape data and dimension data of a dump truck 500 stored in the storage unit 212. For example, when the vehicle height of the dump truck 2 is high, the target position of the unloading operation start position Zs is set to a high position. When the vehicle height of the dump truck 2 is low, the target position of the unloading operation start position Zs is set to a low position. Alternatively, the target value calculation unit 209 may set a target position of the unloading operation start position Zs of the distal end of the boom 31 on the basis of the relation between the ground height at a stop position of the dump truck 500 and the ground height at the position of the wheel loader 1 having come close to the dump truck 500 for the unloading operation. In this case, a known target position may be stored in the storage unit 212 and the target position stored in the storage unit 212 may be used as a target position of the unloading operation start position Zs, or a height position obtained by a sensor for detecting a height may be used as a target position of the unloading operation start position Zs.

The work machine control unit 210 outputs a control signal for feedback control according to a target value calculated by the target value calculation unit 209.

In the present embodiment, if the attitude of the bucket 32 is determined to satisfy the predetermined condition by the determination unit 208, the work machine control unit 210 causes the bucket 32 to carry out the dumping movement and outputs a control signal to causes the boom 31 to carry out the lifting movement concurrently with at least part of the dumping movement of the bucket.

In the present embodiment, if the attitude of the bucket 32 is determined not to satisfy the predetermined condition by the determination unit 208, the work machine control unit 210 outputs a control signal to maintain the position of the boom 31 during the dumping movement of the bucket 32.

In the present embodiment, if the bucket angle β, which is a detected angle of the bucket 32, is determined to satisfy the condition of being not larger than the threshold A representing the reference angle of the bucket 32, the work machine control unit 210 outputs a control signal to cause the boom 31 to carry out the lifting movement concurrently with at least part of the dumping movement of the bucket 32. If the bucket angle β, which is a detected angle of the bucket 32, is determined not to satisfy the condition of being not larger than the threshold A representing the reference angle of the bucket 32, the work machine control unit 210 outputs a control signal to maintain the position of the distal end of the boom 31 in the vertical direction during the dumping movement of the bucket 32.

After placing the boom 31 at the unloading operation start position Zs, the work machine control unit 210 starts the dumping movement of the bucket 32. When a start signal generated as a result of the operator's manipulation of the automatic unloading control switch 83 is acquired by the work machine control unit 210, the dumping movement of the bucket 3 is carried out. During one dumping movement of the bucket 32, the work machine control unit 210 outputs a control signal so that the bucket 32 carries out the dumping movement with the boom 31 maintained at the unloading operation start position Zs within the "first turning zone of the bucket 32" in which the bucket angle β, which is a detected angle is larger than the threshold A, which is the reference angle, and the bucket 32 carries out the dumping movement while the boom 31 carries out the lifting movement within the "second turning zone of the bucket 32" in which the bucket angle β is not larger than the threshold A.

In other words, the work machine control unit 210 outputs a control signal so that the work machine 3 carries out combined operation when the bucket angle β is not larger than threshold A, and outputs a control signal o that the work machine 3 carries out sole operation when the bucket β is larger than the threshold A.

In addition, the work machine control unit 210 changes the unloading operation start position Zs of the boom 31 on the basis of the number of times of unloading counted by the number-of-unloading counting unit 204. In the present embodiment, the work machine control unit 210 sets the unloading operation start position Zs of the boom 31 to be higher as the number of times of unloading is larger.

In addition, when a start signal generated as a result of manipulation of the automatic unloading control switch 83 is acquired, when the bucket 32 is in the loaded state, and when the boom angle α, which is a detected angle of the boom 31 detected by the boom angle sensor 46, is determined to be not smaller than the threshold A, the work machine control unit 210 starts output of a control signal for the automatic unloading control.

In addition, when the bucket 32 is in the unloaded state and when a control signal acquired by manipulation of the forward/reverse switch 73 is acquired and the wheel loader 1 is determined to be moving rearward, the work machine control unit 210 cancels output of a control signal for the automatic unloading control.

The display control unit 211 controls the display device 61. The display control unit 211 generates display data to be displayed on the display device 61 and outputs the display data to the display device 61.

[Control Method]

Figure 14:
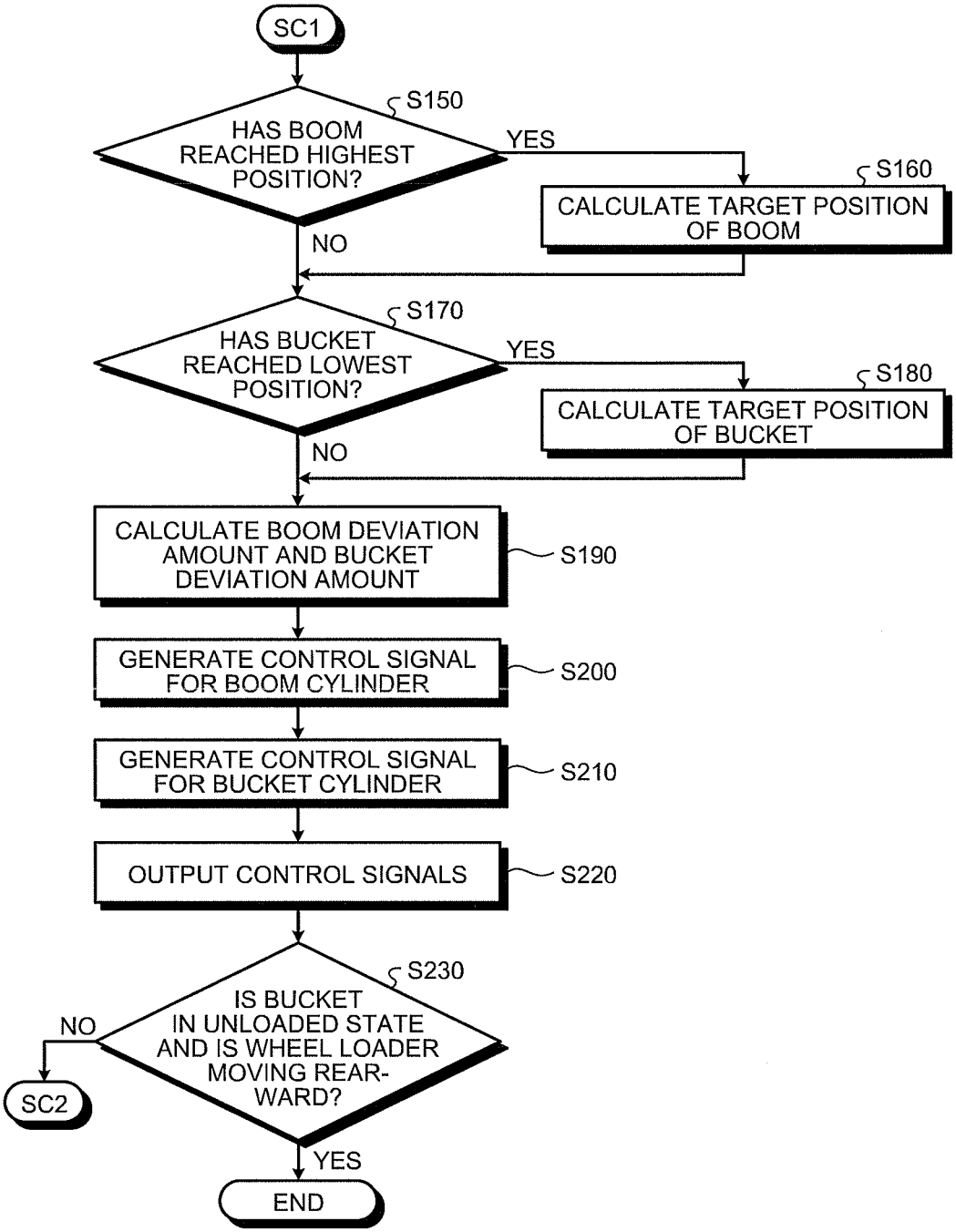
FIG. 14 is a flowchart illustrating the example of the loader control method according to the embodiment.

Next, a method for controlling the wheel loader 1 according to the present embodiment will be described. FIGS. 13 and 14 are flowcharts illustrating an example of the method for controlling the wheel loader 1 according to the present embodiment.

The display control unit 211 displays display data for prompting the operator to select whether or not to carry out the automatic unloading control on the display device 61 of the monitor 60 (step S10).

The operator of the wheel loader 1 visually recognizes the display data on the display device 61, selects whether or not to carry out the automatic unloading control, and manipulates the input device 62. Input data generated as a result of the manipulation of the input device 62 are acquired by the input data acquisition unit 202.

The determination unit 208 determines whether or not to enable an automatic unloading control mode on the basis of the input data (step S20).

If it is determined in step S20 that the automatic unloading control mode is to be enabled (step S20: Yes), the display control unit 211 displays an indicator indicating that the automatic unloading control mode is enabled on the display device 61 (step S30).

Figure 15:
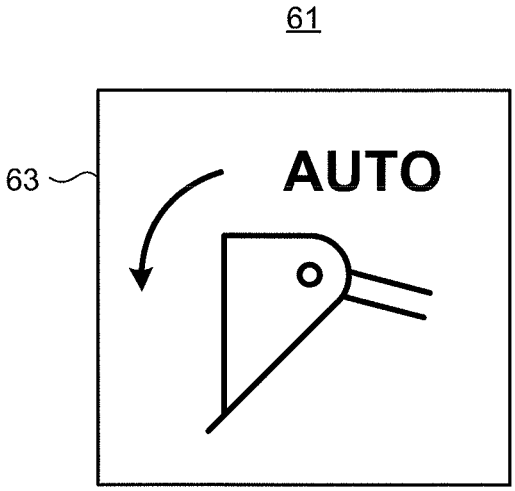
FIG. 15 is a diagram illustrating an example of an indicator displayed on a display device according to the embodiment.

FIG. 15 is a diagram illustrating an example of an indicator 63 displayed on the display device 61 according to the present embodiment. When the automatic unloading control mode is enabled, the display control unit 211 displays the indicator 63 indicating that the automatic unloading control mode is enabled as illustrated in FIG. 15 on the display device 61. Alternatively, the display device 61 may also output sound indicating that the automatic unloading control mode is enabled together with the display of the indicator 63.

In contrast, if it is determined in step S20 that the automatic unloading control mode is not to be enabled (step S20: No), the display control unit 211 hides the indicator indicating that the automatic unloading control mode is enabled on the display device 61 (step S240).

The operator manipulates the control lever 8 to shovel soil SR with the bucket 32. If the operator wants to carry out the automatic unloading control, the operator manipulates the automatic unloading control switch 83. A start signal generated as a result of manipulation of the automatic unloading control switch 83 is output to the start signal acquisition unit 203.

The determination unit 208 determines whether or not a start signal generated as a result of manipulation of the automatic unloading control switch 83 is acquired by the start signal acquisition unit 203 (step S40).

If it is determined in step S40 that a start signal is acquired (step S40: Yes), the resetting unit 205 initializes the target position of the distal end of the boom 31 in the vertical direction (step S50).

The target value calculation unit 209 sets the target position of the unloading operation start position Zs of the distal end of the boom 31 at the starting point of the unloading operation on the basis of the number of times of unloading counted by the number-of-unloading counting unit 204. For the first unloading operation, the target value calculation unit 209 sets the target position of the distal end of the boom 31 to the unloading operation start position Zs1. For the second unloading operation, the target value calculation unit 209 sets the target position of the distal end of the boom 31 to the unloading operation start position Zs2 higher than the unloading operation start position Zs1. For the third unloading operation, the target value calculation unit 209 sets the target position of the distal end of the boom 31 to the unloading operation start position Zs3 higher than the unloading operation start position Zs2. For the fourth unloading operation, the target value calculation unit 209 sets the target position of the distal end of the boom 31 to the unloading operation start position Zs4 higher than the unloading operation start position Zs3.

The target value calculation unit 209 sets a target position of the unloading operation start position Zs. As described above, setting data indicating the unloading operation start position Zs set through teaching is stored in the storage unit 212. The target value calculation unit 209 sets the target position of the unloading operation start position Zs of the distal end of the boom 31 on the basis of the setting data stored in the storage unit 212. Alternatively, the target value calculation unit 209 may set a target position of the unloading operation start position Zs of the distal end of the boom 31 on the basis of outer shape data and dimension data of a dump truck 500 stored in the storage unit 212.

The determination unit 208 determines whether or not an end condition for ending the automatic unloading control is satisfied (step S60).

In the present embodiment, the end condition of the automatic unloading control is satisfied when at least one of a condition that the automatic unloading control mode explained in step S20 is not enabled, a condition that detection data of the bucket angle sensor 46 cannot be acquired, a condition that detection data of the boom angle sensor 47 cannot be acquired, and a condition that detection data of the boom cylinder pressure sensor 48 cannot be acquired.

If it is determined in step S60 that the end condition is not satisfied (step S60): No), the determination unit 208 determines whether or not the bucket 32 in the loaded state (step S70).

Detection data of the boom cylinder pressure sensor 48 are output to the detection data acquisition unit 201. The determination unit 208 determines whether or not the bucket 32 is in the loaded state on the basis of the detection data of the boom cylinder pressure sensor 48 acquired by the detection data acquisition unit 201.

If it is determined in step S70 that the bucket 32 is in the loaded state (step S70: Yes), the determination unit 208 determines whether or not the position of the boom 31 is not smaller than a threshold F (step S80).

As described above, the position of the distal end of the boom 31 is uniquely defined on the basis of the boom angle α, which is a detected angle of the boom 31, and the work machine data. In the present embodiment, it is determined whether or not the boom angle α, which is a detected angle of the boom 31, is not smaller than 0[°]. Specifically, in the present embodiment, the threshold F is a position of the distal end of the boom 31 when the boom angle α is 0[°].

The boom angle α, which is a detected angle of the boom 31 is detected by the boom angle sensor 46. Detection data of the boom angle sensor 46 are output to the detection data acquisition unit 201. The determination unit 208 determines whether or not the boom angle α is not smaller than 0[°] on the basis of the detection data of the boom angle sensor 46 acquired by the detection data acquisition unit 201. Note that the threshold F for the boom angle α need not be 0[°].

If it is determined in step S80 that the boom angle α is not smaller than 0[°] (step S80: Yes), the work machine control unit 210 starts the automatic unloading control. Thus, if the start signal is acquired, if the bucket 32 is in the loaded state, and if the detected angle α of the boom 31 is determined to be not smaller than 0[°], the work machine control unit 210 starts output of a control signal for the automatic unloading control.

The display control unit 211 displays an indicator indicating that the automatic unloading control is started on the display device 61 (step S90).

Figure 16:
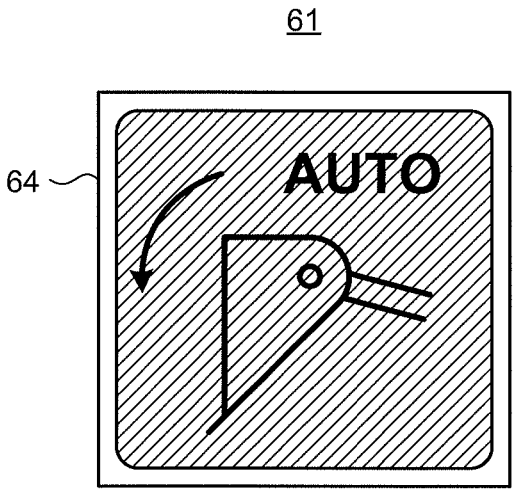
FIG. 16 is a diagram illustrating an example of an indicator displayed on the display device according to the embodiment.

FIG. 16 is a diagram illustrating an example of an indicator 64 displayed on the display device 60 according to the present embodiment. When the automatic unloading control is started, the display control unit 211 displays the indicator 64 indicating that the automatic unloading control is being carried out as illustrated in FIG. 16 on the display device 61.

The determination unit 208 determines whether or not the bucket angle β, which is a detected angle of the bucket 32, is not larger than the threshold A (step S100).

Note that, if it is determined in step S40 that a start signal is not acquired (step S40: No), the method returns to the processing in step S40. If it is determined in step S60 that the end condition is satisfied (step S60: Yes), if it is determined in step S70 that the bucket 32 is not in the loaded state (step S70: No), or if it is determined in step S80 that the boom angle α is not 0[°] or larger (step S80: No), the target position of the boom 31 is initialized and set to the current position of the boom 31 (step S250), and the method then returns to the processing in step S40.

In the present embodiment, the threshold A in the processing in step S100 is set to the bucket angle β at which the bucket 32 and soil SR in the vessel 501 are likely to come into contact with each other during the unloading operation. In the present embodiment, the threshold A in the processing in step S100 is 0[°]. In step S100, the determination unit 208 determines whether or not the bucket angle β is not larger than 0[°]. Note that the threshold A need not be 0[°], and may be determined within a range of the bucket angle β between −5[°] and +5[°], for example.

If it is determined in step S100 that the bucket angle β is larger than the threshold A (step S100: No), the target value calculation unit 209 calculates a target position of the distal end of the boom 31 for the sole operation of the work machine 3 (step S110).

In the present embodiment, the target value calculation unit 209 sets the current position of the distal end of the boom 31 calculated on the basis of the current boom angle α detected by the boom angle sensor 46 to the target position of the distal end of the boom 31. The target value calculation unit 209 sets the current position of the distal end of the boom 31 calculated from the detection data of the boom angle sensor 46 to the target position in the vertical direction of the distal end of the boom 31. The target value calculation unit 209 is capable of calculating the current position in the vertical direction of the distal end of the boom 31 on the basis of the detection data of the boom angle sensor 46 and the work machine data, which are known data stored in the storage unit 212.

The target value calculation unit 209 also calculates a target angle and a target position of the bucket 32 for the sole operation of the work machine 3 (step S120).

The target value calculation unit 209 calculates a target value of the bucket angle β by subtracting a predetermined angle instruction value B from the current bucket angle β detected by the bucket angle sensor 47. The target value calculation unit 209 also calculates the current stroke length of the bucket cylinder 42 on the basis of detection data of the bucket angle sensor 47. The bucket angle β and the stroke length of the bucket cylinder 42 are correlated. Correlation data of the bucket angle β and the stroke length of the bucket cylinder 42 are known data stored in the storage unit 212. The target value calculation unit 209 is capable of calculating the current stroke length of the bucket cylinder 42 on the basis of detection data of the bucket angle sensor 47. The target value calculation unit 209 calculates a target value of the stroke length of the bucket cylinder 42 with which the bucket angle β reaches the target value.

The target value calculation unit 209 also calculates the current position of the bucket 32 in the vertical direction on the basis of detection data of the bucket angle sensor 47. The bucket angle β and the position of the bucket 32 are correlated. Correlation data of the bucket angle β and the position of the bucket 32 are known data stored in the storage unit 212. The target value calculation unit 209 is capable of calculating the current position of the bucket 32 on the basis of detection data of the bucket angle sensor 47. The target value calculation unit 209 calculates a target value of the stroke length of the bucket cylinder 42 with which the bucket 32 reaches the target position.

Specifically, for the sole operation of the work machine 3, the target value calculation unit 209 calculates a target value of a cylinder length of the bucket cylinder 42 and a target value of the bucket angle β so that the cylinder length of the bucket cylinder 42 becomes gradually shorter with time and that the bucket angle β becomes gradually smaller with time.

If it is determined in step S100 that the bucket angle β is not larger than the threshold A (step S100: Yes), the target value calculation unit 209 calculates a target position of the boom 31 for the associated operation of the work machine 3 (step S130).

In the present embodiment, the target value calculation unit 209 calculates a target value of the boom angle α by adding a predetermined angle instruction value C to the current boom angle α varying with time detected by the boom angle sensor 46. The target value calculation unit 209 also calculates the current stroke length of the boom cylinder 41 on the basis of detected data of the boom angle sensor 46. The boom angle α and the stroke length of the boom cylinder 41 are correlated. Correlation data of the boom angle α and the stroke length of the boom cylinder 41 are known data stored in the storage unit 212. The target value calculation unit 209 is capable of calculating the current stroke length of the boom cylinder 41 on the basis of detection data of the boom angle sensor 46. The target value calculation unit 209 calculates a target value of the stroke length of the boom cylinder 41 with which the boom angle α reaches the target value.

The target value calculation unit 209 also calculates the current position of the distal end of the boom 31 on the basis of detection data of the boom angle sensor 46. The boom angle α and the position of the distal end of the boom 31 are correlated. Correlation data of the boom angle α and the position of the distal end of the boom 31 are known data stored in the storage unit 212. The target value calculation unit 209 is capable of calculating the current position of the distal end of the boom 31 on the basis of detection data of the boom angle sensor 46. The target value calculation unit 209 calculates a target value of the stroke length of the boom cylinder 41 with which the distal end of the boom 31 reaches the target position.

The target value calculation unit 209 also calculates a target angle and a target position of the bucket 32 for the associated operation of the work machine 3 (step S140).

In the present embodiment, the target value calculation unit 209 calculates a target value of the bucket angle β by subtracting a predetermined angle instruction value D from the current bucket angle β detected by the bucket angle sensor 47. The angle instruction value D is different from the angle instruction value B. The target value calculation unit 209 also calculates the current stroke length of the bucket cylinder 42 on the basis of detection data of the bucket angle sensor 47. The bucket angle β and the stroke length of the bucket cylinder 42 are correlated. Correlation data of the bucket angle β and the stroke length of the bucket cylinder 42 are known data stored in the storage unit 212. The target value calculation unit 209 is capable of calculating the current stroke length of the bucket cylinder 42 on the basis of detection data of the bucket angle sensor 47. The target value calculation unit 209 calculates a target value of the stroke length of the bucket cylinder 42 with which the bucket angle β reaches the target value.

The target value calculation unit 209 also calculates the current position of the bucket 32 on the basis of detection data of the bucket angle sensor 47. The bucket angle β and the position of the bucket 32 are correlated. Correlation data of the bucket angle β and the position of the bucket 32 are known data stored in the storage unit 211. The target value calculation unit 209 is capable of calculating the current position of the bucket 32 on the basis of detection data of the bucket angle sensor 47. The target value calculation unit 209 calculates a target value of the stroke length of the bucket cylinder 42 with which the bucket 32 reaches the target position.

Specifically, for the associated operation of the work machine 3, the target value calculation unit 209 calculates a target value of the cylinder length of the bucket cylinder 42 and a target value of the bucket angle β so that the cylinder length of the bucket cylinder 42 becomes gradually shorter with time and that the bucket angle β becomes gradually smaller with time. In addition, for the associated operation of the work machine 3, the target value calculation unit 209 calculates a target value of the cylinder length of the boom cylinder 41, a target value of the boom angle α, and a target value of the position of the distal end of the boom 31 so that the cylinder length of the boom cylinder 41 becomes gradually longer with time, that the boom angle α becomes gradually larger with time, and that the position of the distal end of the boom 31 becomes gradually higher.

The determination unit 208 determines whether or not the boom cylinder 41 has reached an end of the movable range and the distal end of the boom 31 has reached the highest position, which is the unloading operation end position Ze, on the basis of detection data of the boom angle sensor 46 (step S150).

If it is determined in step S150 that the distal end of the boom 31 has reached the highest position (step S150: Yes), the target value calculation unit 209 calculates a target position of the distal end of the boom 31 (step S160). The target position of the distal end of the boom 31 is set to the current position of the distal end of the boom 31 defined on the basis of detection data of the boom angle sensor 46.

The determination unit 208 determines whether or not the bucket cylinder 42 has reached an end of the movable range and the bucket 32 has reached the lowest position, which is a lower end of the movable range in the dumping movement on the basis of detection data of the bucket angle sensor 47 (step S170).

If it is determined in step S170 that the bucket 32 has reached the lowest position (step S170: Yes), the target value calculation unit 209 calculates a target position of the bucket 32 (step S180). The target position of the bucket 32 is set to the current position of the bucket 32 defined on the basis of detection data of the bucket angle sensor 47.

The work machine control unit 210 calculates a boom deviation amount indicating the amount of deviation between the target position of the boom 31 and the current position of the boom 31, and calculates a bucket deviation amount indicating the amount of deviation between the target position of the bucket 32 and the current position of the bucket 32 (step S190). Specifically, the work machine control unit 210 obtains the boom angle α with respect to the target position of the boom 31 and the boom angle α with respect to the current position of the boom 31, and calculates a deviation angle therebetween as a boom deviation angle. The work machine control unit 210 also obtains the bucket angle β with respect to the target position of the bucket 32 and the bucket angle β with respect to the target position of the bucket 32, and converts a deviation angle therebetween to a stroke amount of the bucket cylinder 42 corresponding to the deviation angle to calculate a bucket deviation length.

The work machine control unit 210 calculates the amount of manipulation of the boom control lever 81 to move the boom 31 to the target position on the basis of the calculated boom deviation amount and correlation data indicating the relation between the boom deviation angle and a target flow rate of hydraulic fluid to be supplied to the boom cylinder 41, which are stored in the storage unit 212. Specifically, the work machine control unit 210 obtains the target flow rate of hydraulic fluid with respect to the calculated boom deviation angle from correlation data illustrated in FIG. 17, and calculates the amount of manipulation of the boom control lever 81 with respect to the target flow rate. The work machine control unit 210 generates a control signal corresponding to the calculated amount of manipulation of the boom control lever 81 (step S200).

The work machine control unit 210 calculates the amount of manipulation of the bucket control lever 82 to move the bucket 32 to the target position on the basis of the calculated bucket deviation amount and correlation data indicating the relation between the bucket deviation length and the target flow rate of hydraulic fluid to be supplied to the bucket cylinder 42, which are stored in the storage unit 212. Specifically, the work machine control unit 210 obtains the target flow rate of hydraulic fluid with respect to the calculated bucket deviation length from correlation data illustrated in FIG. 18, and calculates the amount of manipulation of the bucket control lever 82 with respect to the target flow rate. The work machine control unit 210 generates a control signal corresponding to the calculated amount of manipulation of the bucket control lever 82 (step S210).

Figure 17:
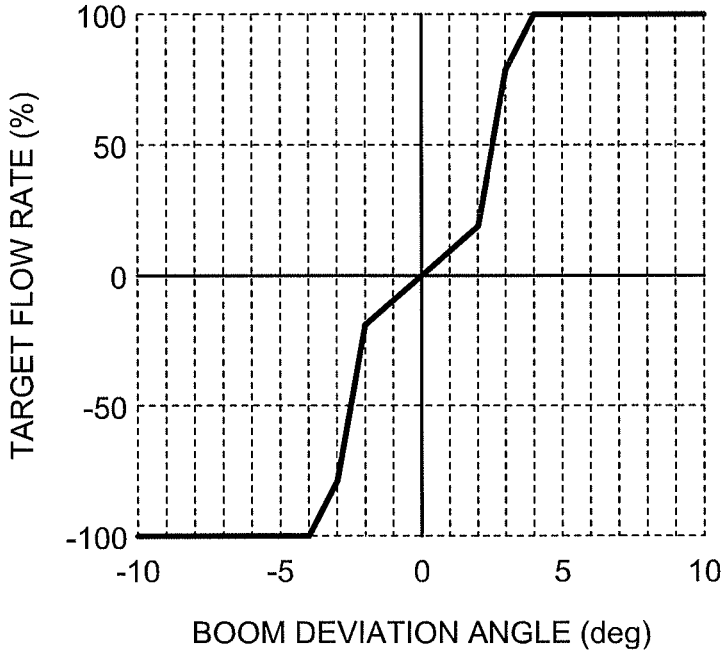
FIG. 17 is a graph illustrating an example of correlation data indicating the relation between a boom deviation angle and a target flow rate of hydraulic fluid according to the embodiment.
Figure 18:
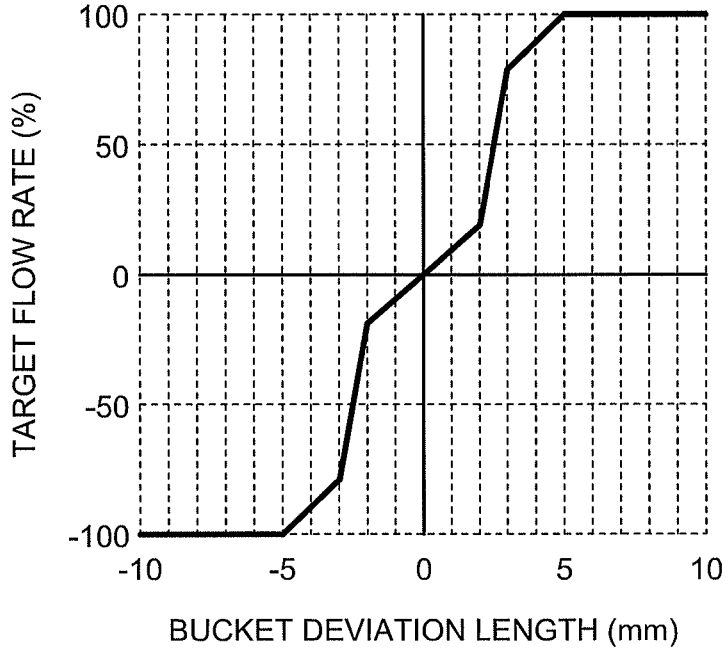
FIG. 18 is a graph illustrating an example of correlation data indicating the relation between a bucket deviation length and a target flow rate of hydraulic fluid according to the embodiment.

FIG. 17 is an example of the correlation data indicating the relation between the boom deviation angle and the target flow rate of hydraulic fluid to be supplied to the boom cylinder 41, which are stored in the storage unit 212, according to the present embodiment. FIG. 18 is an example of the correlation data indicating the relation between the bucket deviation length and the target flow rate of hydraulic fluid to be supplied to the bucket cylinder 42, which are stored in the storage unit 212, according to the present embodiment.

After the control signals are generated, the work machine control unit 210 outputs the control signals for controlling the boom cylinder 41 and the bucket cylinder 42 (step S220).

The determination unit 208 determines whether or not the bucket 32 is in the unloaded state and the wheel loader 1 is moving rearward on the basis of detection data of the boom cylinder pressure sensor 48 and a control signal generated by the forward/reverse switch 73 (step S230).

If it is not determined in step S230 that the bucket 32 is in the unloaded state and the wheel loader 1 is moving rearward (step S230: No), the method returns to step S60 and the processing in the above-described steps is continued.

If it is determined in step S230 that the bucket 32 is in the unloaded state and the wheel loader 1 is moving rearward (step S230: Yes), one unloading operation is terminated.

Note that, if it is determined in step S150 that the distal end of the boom 31 has not reached the highest position (step S150: No), the processing in step S170 is performed without the processing in step S160. If it is determined in step S170 that the bucket 32 has not reached the lowest position (step S170: No), the processing in step S190 is performed without the processing in step S180.

The processing in steps S60 to S230 described above is carried out with a predetermined sampling period.

Note that, in the present embodiment, when the boom control lever 81 is manipulated forward by the operator while the boom 31 is carrying out the lifting movement concurrently with the dumping movement of the bucket 32 according to the automatic unloading control, the automatic unloading control is terminated and the lifting movement of the boom 31 is stopped.

[Effects]

As described above, according to the present embodiment, the automatic unloading control is carried out, in which the position of the boom 31 rotatably supported by the vehicle body 2 of the wheel loader 1 is calculated, the attitude of the bucket 32 rotatably supported by the boom 31 is calculated, whether or not the calculated attitude of the bucket 32 satisfies the predetermined condition is determined on the basis of the calculated attitude of the bucket 32 and the reference attitude of the bucket 32 in the dumping movement, the bucket 32 is caused to carry out the dumping movement, and the boom 31 is caused to carry out the lifting movement if the calculated attitude of the bucket 32 is determined to satisfy the predetermined condition.

As a result, the wheel loader 1 carries out smooth unloading operation depending on the height of soil SR in the vessel 501. Thus, unloading operation of unloading soil SR from the bucket 32 is smoothly carried out.

While the present embodiment has been described above, the present embodiment is not limited to the description provided above. The components described above include those easily conceivable by those skilled in the art, those which are substantially the same, and so-called their equivalents. Furthermore, the above-described components may be appropriately combined. Furthermore, it is also possible to variously omit, replace, and change the components without departing from the gist of this embodiment.

REFERENCE SIGNS LIST

1 WHEEL LOADER (LOADER)
2 VEHICLE BODY
3 WORK MACHINE
4 HYDRAULIC CYLINDER
5 TRAVELING DEVICE
6 CAB
7 SEAT
8 CONTROL LEVER
9 WHEEL ASSEMBLY
9F FRONT WHEEL
9R REAR WHEEL
10 TIRE
10F FRONT TIRE
10R REAR TIRE
11 FLUID PASSAGE
12 HYDRAULIC PUMP
13 BOOM CONTROL VALVE
14 BUCKET CONTROL VALVE
16 ENGINE
17 POWER TAKEOFF
18 TRANSMISSION
20 ELECTROMAGNETIC PROPORTIONAL CONTROL VALVE
21 BOOM LOWERING ELECTROMAGNETIC PROPORTIONAL CONTROL VALVE
21S SOLENOID CONTROL PART
22 BOOM LIFTING ELECTROMAGNETIC PROPORTIONAL CONTROL VALVE
22S SOLENOID CONTROL PART
23 BUCKET DUMPING ELECTROMAGNETIC PROPORTIONAL CONTROL VALVE
23S SOLENOID CONTROL PART
24 BUCKET TILTING ELECTROMAGNETIC PROPORTIONAL CONTROL VALVE
24S SOLENOID CONTROL PART
31 BOOM
31B BRACKET
31P COUPLING PIN
31Q COUPLING PIN
32 BUCKET
32B BOTTOM SURFACE
32M OPENING
32P COUPLING PIN
32Q COUPLING PIN
32T BLADE
33 BELL CRANK
33P COUPLING PIN
33Q COUPLING PIN
33R COUPLING PIN
34 BUCKET LINK
35 SUPPORTING MEMBER
41 BOOM CYLINDER
41P COUPLING PIN
41Q COUPLING PIN
42 BUCKET CYLINDER
42P COUPLING PIN
46 BOOM ANGLE SENSOR
47 BUCKET ANGLE SENSOR
48 BOOM CYLINDER PRESSURE
49 SPEED SENSOR
51 FIRST POTENTIOMETER
52 SECOND POTENTIOMETER
60 MONITOR DEVICE
61 DISPLAY DEVICE
62 INPUT DEVICE
63 INDICATOR
70 STEERING LEVER
71 ACCELERATOR PEDAL
72R RIGHT BRAKE PEDAL
72L LEFT BRAKE PEDAL
73 FORWARD/REVERSE SWITCH
81 BOOM CONTROL LEVER
82 BUCKET CONTROL LEVER
83 AUTOMATIC UNLOADING CONTROL SWITCH
84 RESET SWITCH
85 POSITIONER SETTING SWITCH
100 CONTROL SYSTEM
200 CONTROLLER
200A ARITHMETIC PROCESSING UNIT
200B STORAGE PROGRAM
200C COMPUTER PROGRAM
201 DETECTION DATA ACQUISITION UNIT
202 INPUT DATA ACQUISITION UNIT
203 START SIGNAL ACQUISITION UNIT
204 NUMBER-OF-UNLOADING COUNTING UNIT
205 RESETTING UNIT
206 BOOM POSITION CALCULATION UNIT
207 BUCKET ATTITUDE CALCULATION UNIT
208 DETERMINATION UNIT
209 TARGET VALUE CALCULATION UNIT
210 WORK MACHINE CONTROL UNIT
211 DISPLAY CONTROL UNIT
212 STORAGE UNIT
213 INPUT/OUTPUT UNIT
500 DUMP TRUCK
501 VESSEL
AXA BOOM ROTATION AXIS
AXB BUCKET ROTATION AXIS
AXC BELL CRANK ROTATION AXIS
GR GROUND
LA LINE
LB LINE
LR REFERENCE LINE
SR SOIL
ZE UNLOADING OPERATION END POSITION
ZE1 UNLOADING OPERATION END POSITION
ZE2 UNLOADING OPERATION END POSITION
ZE3 UNLOADING OPERATION END POSITION
ZE4 UNLOADING OPERATION END POSITION
ZM POSITION
ZS UNLOADING OPERATION START POSITION
ZSA POSITION
ZSB POSITION
ZS1 UNLOADING OPERATION START POSITION
ZS2 UNLOADING OPERATION START POSITION
ZS3 UNLOADING OPERATION START POSITION
ZS4 UNLOADING OPERATION START POSITION

The invention claimed is:

1. A loader control system, comprising:

a boom position calculation unit configured to calculate a position of a boom rotatably supported by a vehicle body of a loader;

a bucket attitude calculation unit configured to calculate an attitude of a bucket rotatably supported by the boom;

a determination unit configured to determine whether or not the attitude satisfies a predetermined condition on a basis of the attitude and a reference attitude of the bucket in dumping movement; and a work machine control unit configured to cause the bucket to carry out the dumping movement, and output a control signal to cause the boom to carry out lifting movement when the attitude is determined to satisfy the predetermined condition.

2. The loader control system according to claim 1, wherein when the attitude is determined not to satisfy the predetermined condition, the work machine control unit outputs a control signal to maintain the position of the boom during the dumping movement of the bucket.

3. The loader control system according to claim 1, wherein the attitude includes a detected angle which is an angle calculated on a basis of detection data of the attitude of the bucket, the reference attitude includes a reference angle which is an angle of reference of the bucket, after placing the boom at an unloading operation start position, the work machine control unit starts the dumping movement of the bucket, within a first turning zone of the bucket in which the detected angle is larger than the reference angle, the bucket carries out the dumping movement with the boom maintained at the unloading operation start position, and within a second turning zone of the bucket in which the detected angle is not larger than the reference angle, the bucket carries out the dumping movement while the boom carries out lifting movement.

4. The loader control system according to claim 1, further comprising:

a number-of-unloading counting unit configured to count number of times unloading operation is carried out with respect to one object into which soil is to be unloaded, the unloading operation unloading soil from the bucket into the object, wherein the work machine control unit changes an unloading operation start position of the boom on a basis of the number of times of unloading.

5. The loader control system according to claim 4, wherein the work machine control unit sets the unloading operation start position of the boom to be higher as the number of times of unloading is larger.

6. The loader control system according to claim 1, further comprising:

a load sensing device configured to detect whether the bucket is in an unloaded state or a loaded state; and a start signal acquisition unit configured to acquire a start signal instructing to start control of the dumping movement, the start signal being generated by a manipulation device, wherein the work machine control unit starts output of the control signal when the start signal is acquired, when the load sensing device has detected that the bucket is in the loaded state, and when a detected angle of the boom is determined to be not smaller than a threshold.

7. The loader control system according to according to claim 1, wherein the work machine control unit cancels output of the control signal when the load sensing device has detected that the bucket is in an unloaded state, and when the loader is determined to be moving rearward.

8. A loader control method comprising:

calculating an attitude of a bucket rotatably supported by a boom in dumping movement of the bucket; and causing the boom to carry out lifting movement when the attitude satisfies a predetermined condition.

9. The loader control method according to claim 8, further comprising:

counting number of times unloading operation is carried out with respect to one object into which soil is to be unloaded, the unloading operation unloading soil from the bucket into the object; and changing an unloading operation start position of the boom on a basis of the number of times of unloading.

* * * * *